US010208987B2

(12) United States Patent
Ikeda et al.

(10) Patent No.: US 10,208,987 B2
(45) Date of Patent: Feb. 19, 2019

(54) HEAT PUMP WITH AN AUXILIARY HEAT EXCHANGER FOR COMPRESSOR DISCHARGE TEMPERATURE CONTROL

(71) Applicant: MITSUBISHI ELECTRIC CORPORATION, Chiyoda-ku (JP)

(72) Inventors: Soshi Ikeda, Chiyoda-ku (JP); Shinichi Wakamoto, Chiyoda-ku (JP); Naofumi Takenaka, Chiyoda-ku (JP); Koji Yamashita, Chiyoda-ku (JP); Takeshi Hatomura, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 176 days.

(21) Appl. No.: 15/117,103

(22) PCT Filed: Feb. 16, 2015

(86) PCT No.: PCT/JP2015/054175
§ 371 (c)(1),
(2) Date: Aug. 5, 2016

(87) PCT Pub. No.: WO2015/125743
PCT Pub. Date: Aug. 27, 2015

(65) Prior Publication Data

US 2017/0167761 A1 Jun. 15, 2017

(30) Foreign Application Priority Data

Feb. 18, 2014 (JP) ..... 2014-028782

(51) Int. Cl.
*F25B 13/00* (2006.01)
*F25B 41/04* (2006.01)
(Continued)

(52) U.S. Cl.
CPC ..... *F25B 13/00* (2013.01); *F25B 31/006* (2013.01); *F25B 41/04* (2013.01); *F25B 41/043* (2013.01);
(Continued)

(58) Field of Classification Search
CPC ..... F25B 13/00; F25B 2313/02741; F25B 2500/08; F25B 2600/2501; F25B 2700/21152; F25B 41/043
(Continued)

(56) References Cited

U.S. PATENT DOCUMENTS 4,232,529 A * 11/1980 Babbitt ..... F24D 17/02 62/160
6,295,821 B1 * 10/2001 Madigan ..... F04C 29/0014 62/117
(Continued)

FOREIGN PATENT DOCUMENTS

JP 6-341740 A 12/1994
JP 7-280378 A 10/1995
(Continued)

OTHER PUBLICATIONS

International Search Report dated May 19, 2015 in PCT/JP2015/054175 Filed Feb. 16, 2015.
Extended European Search Report dated Sep. 26, 2017 in Patent Application No. 15752562.7.

*Primary Examiner* — Henry T Crenshaw
(74) *Attorney, Agent, or Firm* — Oblon, McClelland, Maier & Neustadt, L.L.P.

(57) ABSTRACT

An air-conditioning apparatus includes a bypass pipe that has one end connected to the discharge side of a compressor and through which refrigerant exiting the compressor flows, an auxiliary heat exchanger that is connected to the other end of the bypass pipe and the suction part of the compressor, and cools refrigerant flowing through the bypass pipe and
(Continued)

supplies the cooled refrigerant to the suction part of the compressor, and a flow regulating unit that is provided on the refrigerant outlet side of the auxiliary heat exchanger, and regulates the flow rate of refrigerant routed into the suction part of the compressor from the auxiliary heat exchanger.

15 Claims, 11 Drawing Sheets

(51) Int. Cl.
*F25B 49/02* (2006.01)
*F25B 31/00* (2006.01)

(52) U.S. Cl.
CPC ..... *F25B 49/02* (2013.01); *F25B 2313/006* (2013.01); *F25B 2313/021* (2013.01); *F25B 2313/0231* (2013.01); *F25B 2313/0233* (2013.01); *F25B 2313/0272* (2013.01); *F25B 2313/02732* (2013.01); *F25B 2313/02741* (2013.01); *F25B 2313/0311* (2013.01); *F25B 2313/0314* (2013.01); *F25B 2400/05* (2013.01); *F25B 2400/13* (2013.01); *F25B 2400/23* (2013.01); *F25B 2500/08* (2013.01); *F25B 2600/0261* (2013.01); *F25B 2600/0271* (2013.01); *F25B 2600/2501* (2013.01); *F25B 2700/2106* (2013.01); *F25B 2700/21152* (2013.01)

(58) Field of Classification Search
USPC ..... 62/160
See application file for complete search history.

(56) References Cited

U.S. PATENT DOCUMENTS

| | | | | |
|---|---|---|---|---|
| 6,393,850 | B1 * | 5/2002 | Vanderstraeten | B01D 5/0039 62/196.3 |
| 2005/0160749 | A1 * | 7/2005 | Shaffer | F04D 27/0246 62/228.1 |
| 2009/0025410 | A1 * | 1/2009 | Tanaka | F25B 41/043 62/228.1 |
| 2009/0125257 | A1 * | 5/2009 | Jayanth | F04B 35/04 702/64 |
| 2009/0260376 | A1 * | 10/2009 | Kasahara | F25B 49/005 62/149 |
| 2010/0126211 | A1 * | 5/2010 | Okamoto | F25B 31/004 62/470 |
| 2011/0154840 | A1 * | 6/2011 | Mihara | F25B 9/008 62/196.1 |
| 2014/0165635 | A1 | 6/2014 | Yamashita et al. | |
| 2014/0230476 | A1 * | 8/2014 | Yura | F25B 31/002 62/192 |
| 2015/0107290 | A1 | 4/2015 | Hatomura et al. | |

FOREIGN PATENT DOCUMENTS

| | | | |
|---|---|---|---|
| JP | 11-294886 | A | 10/1999 |
| JP | 2001-330331 | A | 11/2001 |
| JP | 2003-262418 | A | 9/2003 |
| JP | 2008-138921 | A | 6/2008 |
| JP | 2009-228979 | A | 10/2009 |
| JP | 2011-89736 | A | 5/2011 |
| JP | 4812606 | * | 9/2011 |
| JP | 2012-67967 | A | 4/2012 |
| WO | 2013/069351 | A1 | 5/2013 |
| WO | WO 2013/160966 | A1 | 10/2013 |
| WO | WO 2013/175725 | A1 | 11/2013 |

* cited by examiner

HEAT PUMP WITH AN AUXILIARY HEAT EXCHANGER FOR COMPRESSOR DISCHARGE TEMPERATURE CONTROL

TECHNICAL FIELD

The present invention relates to an air-conditioning apparatus used as, for example, a multi-air-conditioning unit for buildings.

BACKGROUND ART

Some of air-conditioning apparatuses known in related art, such as multi-air-conditioning units for buildings, have a refrigerant circuit in which, for example, an outdoor unit to serve as a heat source unit disposed outside a building, and an indoor unit disposed inside the building are connected by pipes. Refrigerant circulates in the refrigerant circuit, and air is heated or cooled by utilizing the rejection or absorption of heat by the refrigerant, thus heating or cooling the air-conditioning target space. In recent years, air-conditioning apparatuses employing fluorocarbon refrigerants with low global warming potentials, such as an R32 refrigerant, have been considered for use in multi-air-conditioning units for buildings.

As opposed to an R410A refrigerant widely used in conventional air-conditioning apparatuses such as multi-air-conditioning units for buildings, an R32 refrigerant is characterized by its high temperature at discharge from the compressor. The high discharge temperature causes problems such as degradation of the refrigerating machine oil, leading to damage to the compressor. Accordingly, to lower the discharge temperature of the compressor, the rotation speed of the compressor needs to be lowered to reduce the compression ratio. This makes it impossible to increase the rotation speed of the compressor, leading to insufficient cooling capacity or insufficient heating capacity. The following approach is being proposed to address this problem. According to this approach, refrigerant in a gas-liquid two-phase state is injected into a medium-pressure chamber, which attains a medium pressure during the compression process of the compressor, thus lowering the discharge temperature of the compressor while allowing for an increase in the rotation speed of the compressor (see, for example, Patent Literature 1).

CITATION LIST

Patent Literature

Patent Literature 1: Japanese Unexamined Patent Application Publication No. 2008-138921 (FIG. 1, FIG. 2, etc.)

SUMMARY OF INVENTION

Technical Problem

In the air-conditioning apparatus described in Patent Literature 1, when the saturation temperature of high-pressure refrigerant becomes equal to or higher than the temperature of the indoor or outdoor air after activation of the air-conditioning apparatus, the high-pressure refrigerant in a gaseous state liquefies as the refrigerant rejects heat to the indoor air or outdoor air. This allows injection of refrigerant in a gas-liquid two-phase state and at a low quality (with a high liquid-phase content) into the medium-pressure part of the compressor, thus lowering the discharge temperature of the compressor. This approach, however, lacks general applicability because the lowering of discharge temperature is possible only for compressors having a structure that injects refrigerant into the medium-pressure part of the compressor. Such compressors with a structure that routes refrigerant into the medium-pressure part of the compressor are more expensive than compressors with no such structure.

The air-conditioning apparatus according to Patent Literature 1 has a circuit configuration that allows injection to be performed also in cooling operation. Specifically, the air-conditioning apparatus according to Patent Literature 1 includes a bypass expansion device that controls the flow rate of refrigerant injected into the medium-pressure chamber of the compressor, and a refrigerant-to-refrigerant heat exchanger that cools the refrigerant flowing from the bypass expansion device. The flow rate of refrigerant routed into the refrigerant-to-refrigerant heat exchanger is controlled by the expansion device to control the temperature at which refrigerant is discharged from the compressor. This arrangement makes it impossible to individually control both the discharge temperature and the degree of subcooling at the condenser outlet by using different target values, making it impossible to properly control the discharge temperature while maintaining an appropriate degree of subcooling.

That is, if the outdoor unit and the indoor unit are connected by a long extension pipe, when the discharge temperature is controlled to a target value, then it is impossible to control the degree of subcooling at the outlet of the outdoor unit to become a target value. In this case, refrigerant to enter the indoor unit can be in a gas-liquid two-phase state owing to the pressure loss along the extension pipe. If an expansion device is provided on the indoor unit side as in, for example, a multi-air-conditioning apparatus having a plurality of indoor units, entry of refrigerant in a gas-liquid two-phase state into the inlet side of the expansion device gives rise to noise, or reduces the reliability of the system such as by introducing instability into the control.

The present invention has been made to address the above-mentioned problem. Accordingly, the present invention provides an air-conditioning apparatus that ensures the reliability of the system even when an inexpensive compressor is used rather than a compressor having a special structure.

Solution to Problem

An air-conditioning apparatus according to the present invention is an air-conditioning apparatus comprising: a refrigeration cycle in which refrigerant circulates, the refrigeration cycle including a compressor, a refrigerant flow switching device, a heat source-side heat exchanger, a load-side expansion device, and a load-side heat exchanger that are connected by a refrigerant pipe; a bypass pipe having one end connected to a discharge side of the compressor, and configured to allow refrigerant exiting the compressor to flow therethrough; an auxiliary heat exchanger connected to an other end of the bypass pipe and a suction part of the compressor, and configured to cool refrigerant flowing through the bypass pipe and supply the cooled refrigerant to the suction part of the compressor; and a flow regulating unit provided on a refrigerant outlet side of the auxiliary heat exchanger, and configured to regulate a flow rate of refrigerant routed into the suction part of the compressor from the auxiliary heat exchanger.

Advantageous Effects of Invention

With the air-conditioning apparatus according to the present invention, the state and flow rate of refrigerant routed into the suction part of the compressor from the bypass pipe are controlled by using the auxiliary heat exchanger, the flow regulating unit, and the second expansion device under all operating conditions to limit a rise in the temperature of refrigerant discharged from the compressor. This configuration allows the reliability of the system to be improved inexpensively without employing a special structure for the compressor.

DESCRIPTION OF EMBODIMENTS

Embodiment 1

Figure 1:
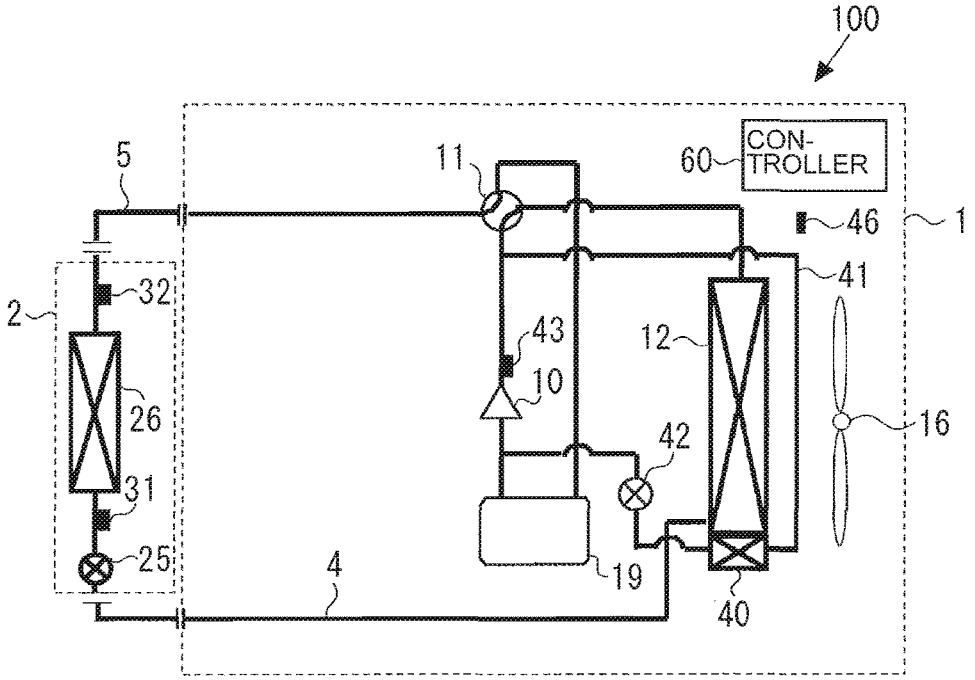
FIG. 1 is a schematic circuit configuration diagram illustrating an exemplary circuit configuration of an air-conditioning apparatus according to Embodiment 1 of the present invention.

Hereinafter, an air-conditioning apparatus according to Embodiment 1 of the present invention will be described with reference to the drawings. FIG. 1 is a schematic circuit configuration diagram illustrating an exemplary circuit configuration of the air-conditioning apparatus according to Embodiment 1. An air-conditioning apparatus 100 illustrated in FIG. 1 includes an outdoor unit 1 and an indoor unit 2 that are connected by a main pipe 5. Although a single indoor unit 2 is connected to the outdoor unit 1 via the main pipe 5 in FIG. 1, this is not intended to limit the number of indoor units 2 to one. Alternatively, a plurality of indoor units 2 may be connected.

[Outdoor Unit 1]

In the outdoor unit 1, a compressor 10, a refrigerant flow switching device 11, a heat source-side heat exchanger 12, an accumulator 19, an auxiliary heat exchanger 40, a flow regulating unit 42, and a bypass pipe 41 are connected by a refrigerant pipe 4 (refrigerant pipes 4), and are mounted together with a fan 16, which is a blower device.

The compressor 10 sucks refrigerant, and compresses the refrigerant into a high-temperature, high-pressure state. For example, the compressor 10 is implemented by an inverter compressor or other compressors whose capacity is controllable. The compressor 10 used is of, for example, a low-pressure shell structure in which a compression chamber is provided inside a hermetic container that is in a low refrigerant-pressure atmosphere, and the low-pressure refrigerant inside the hermetic container is sucked and compressed.

The refrigerant flow switching device 11 is implemented by, for example, a four-way valve. The refrigerant flow switching device 11 switches between the flow path of refrigerant in heating operation mode, and the flow path of refrigerant in cooling operation mode. The heating operation mode refers to the case where the heat source-side heat exchanger 12 serves as a condenser or a gas cooler, and the heating operation mode refers to the case where the heat source-side heat exchanger 12 serves as an evaporator.

The heat source-side heat exchanger 12 serves as an evaporator in heating operation mode, and serves as a condenser in a cooling operation mode. The heat source-side heat exchanger 12 exchanges heat between the air supplied from the fan 16, and the refrigerant. The accumulator 19 connects to the suction part of the compressor 10, and accumulates the excess refrigerant resulting from the difference between the heating operation mode and the cooling operation mode, or the excess refrigerant for transient changes in operation.

Figure 13:
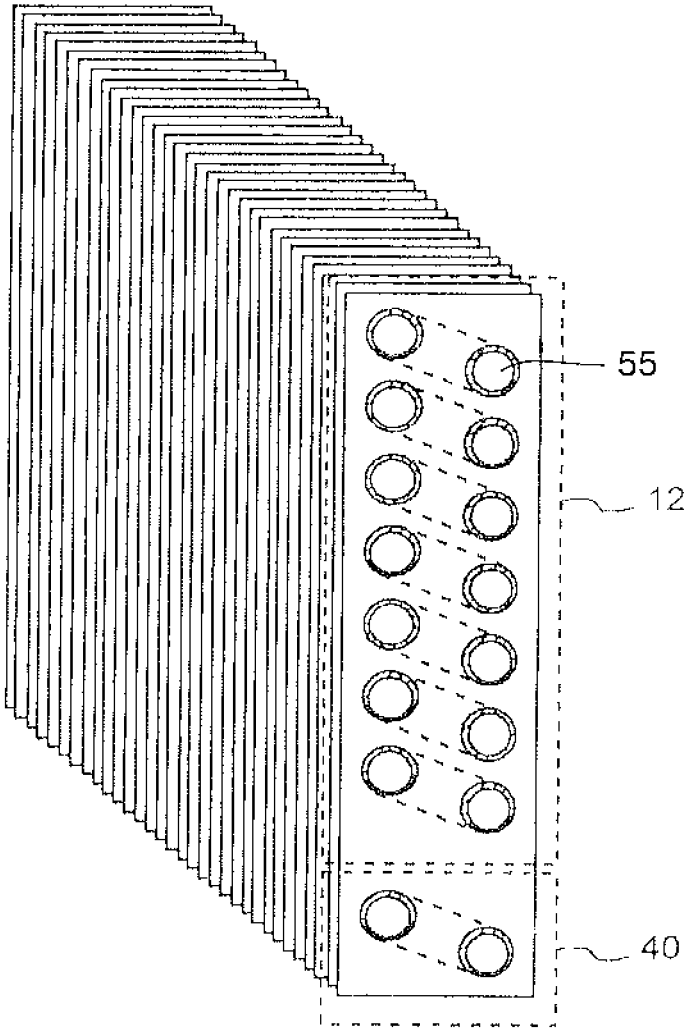
FIG. 13 shows a heat source-side heat exchanger and an auxiliary heat exchanger according to embodiments of the invention.

The auxiliary heat exchanger 40 serves as a condenser in both heating operation mode and cooling operation mode, and exchanges heat between the air supplied from the fan 16 and the refrigerant. As shown in FIG. 13, the structure of the heat source-side heat exchanger 12 and the auxiliary heat exchanger 40 is such that heat transfer tubes 55 forming different refrigerant flow paths are coupled to the same heat transfer fins. Specifically, a plurality of heat transfer fins are arranged adjacent to each other so as to be oriented in the same direction, and a plurality of heat transfer tubes are inserted into a large number of heat transfer fins. The heat source-side heat exchanger 12 and the auxiliary heat exchanger 40 are provided integrally on the same heat transfer fins, with the heat transfer tubes being provided independently from each other. For example, the heat source-side heat exchanger 12 is disposed on the upper side, and the auxiliary heat exchanger 40 is disposed on the lower side, with adjacent heat transfer fins being shared by the two heat exchangers. Thus, the air around the heat source-side heat exchanger 12 flows through both the heat source-side heat exchanger 12 and the auxiliary heat exchanger 40. The auxiliary heat exchanger 40 is disposed such that its heat transfer area is smaller than the heat transfer area of the heat source-side heat exchanger 12. Further, the auxiliary heat exchanger 40 has a heat transfer area necessary for condensing refrigerant so that the refrigerant is in a liquid state at the outlet of the auxiliary heat exchanger 40.

The bypass pipe 41 is used to route a high-pressure refrigerant into the auxiliary heat exchanger 40, and route a liquid refrigerant condensed in the auxiliary heat exchanger 40 into the suction part of the compressor 10 via the flow regulating unit 42. One end of the bypass pipe 41 is connected to the part of the refrigerant pipe 4 between the compressor 10 and the refrigerant flow switching device 11, and the other end is connected to the part of the refrigerant pipe 4 between the compressor 10 and the accumulator 19.

The flow regulating unit 42 is implemented by, for example, a device with a variable opening degree, such as an electronic expansion valve. The flow regulating unit 42 is located on the outflow side of the auxiliary heat exchanger 40. The flow regulating unit 42 regulates the flow rate of the liquid refrigerant that is routed into the suction part of the compressor 10 after being condensed in the auxiliary heat exchanger 40.

Further, the outdoor unit 1 is provided with a discharge temperature sensor 43 that detects the temperature of high-temperature, high-pressure refrigerant discharged from the compressor 10, a refrigerating machine oil temperature sensor 44 that detects the temperature of the refrigerating machine oil in the compressor 10, and a low-side pressure sensor 45 that detects the low-side pressure of refrigerant at the inlet side of the compressor 10. In the outdoor unit 1, an outside-air temperature sensor 46 that measures the temperature around the outdoor unit 1 is provided at the air inlet part of the heat source-side heat exchanger 12.

[Indoor Unit 2]

The indoor unit 2 has a load-side heat exchanger 26, and a load-side expansion device 25. The load-side heat exchanger 26 is connected to the outdoor unit 1 via the main pipe 5. The load-side heat exchanger 26 exchanges heat between air and the refrigerant to generate the heating air or cooling air that is to be supplied to the indoor space. Indoor air is blown to the load-side heat exchanger 26 from a blower device such as a fan (not illustrated). The load-side expansion device 25 is implemented by, for example, a device with a variable opening degree, such as an electronic expansion valve. The load-side expansion device 25 functions as a pressure reducing valve or an expansion valve to reduce the pressure of refrigerant, thus causing the refrigerant to expand. In cooling only operation mode, the load-side expansion device 25 is located upstream of the load-side heat exchanger 26.

The indoor unit 2 is provided with an inlet-side temperature sensor 31 and an outlet-side temperature sensor 32 that are implemented by thermistors or the like. The inlet-side temperature sensor 31 detects the temperature of refrigerant entering the load-side heat exchanger 26, and is provided in the pipe at the refrigerant inlet side of the load-side heat exchanger 26. The outlet-side temperature sensor 32 is located at the refrigerant outlet side of the load-side heat exchanger 26, and detects the temperature of refrigerant exiting the load-side heat exchanger 26.

A controller 60 is implemented by a microcomputer or other devices. The controller 60 executes various operation modes described later by controlling, for example, the driving frequency of the compressor 10, the rotation speed (including ON/OFF) of the blower device, the switching action of the refrigerant flow switching device 11, the opening degree of the flow regulating unit 42, and the opening degree of the load-side expansion device 25, based on information detected by the various sensors mentioned above and instructions from a remote controller. Although the controller 60 is illustrated to be provided in the outdoor unit 1, the controller 60 may be provided for each individual unit, or may be provided in the indoor unit 2.

Next, various operation modes executed by the air-conditioning apparatus 100 will be described. The air-conditioning apparatus 100 executes a cooling operation mode and a heating operation mode for the indoor unit 2 based on an instruction from the indoor unit 2. Operation modes executed by the air-conditioning apparatus 100 illustrated in FIG. 1 include a cooling operation mode in which all of the indoor units 2 being driven execute a cooling operation, and a heating operation mode in which all of the indoor units 2 being driven execute a heating operation. Hereinafter, each of the operation modes will be described with reference to the corresponding flow of refrigerant.

[Cooling Operation Mode]

Figure 2:
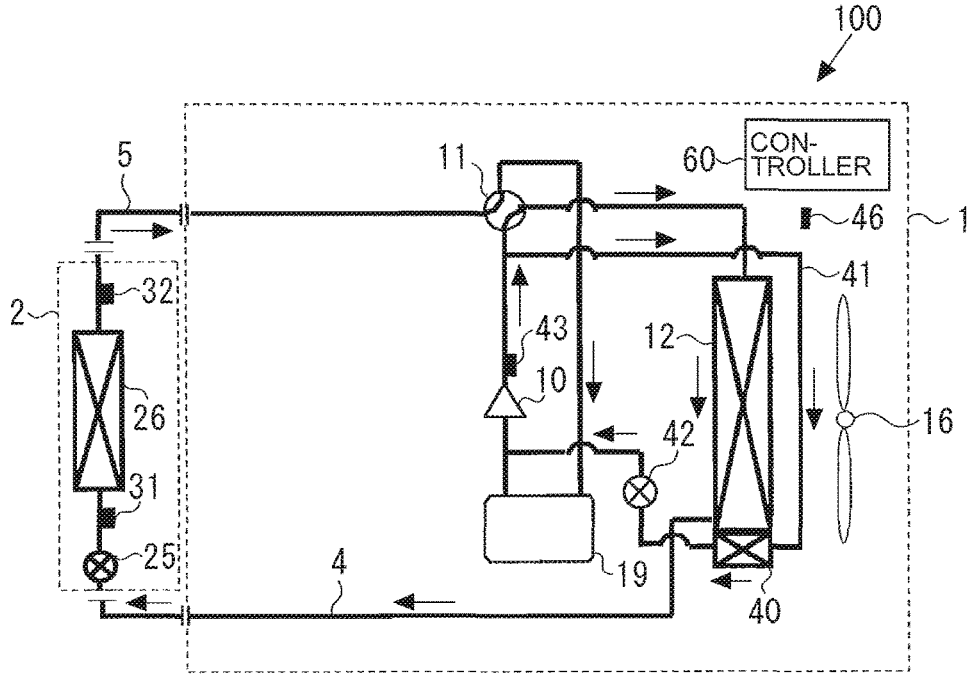
FIG. 2 is a refrigerant circuit diagram illustrating the flow of refrigerant in cooling operation mode of the air-conditioning apparatus according to Embodiment 1 of the present invention.

FIG. 2 is a refrigerant circuit diagram illustrating the flow of refrigerant in cooling operation mode of the air-conditioning apparatus 100. In FIG. 2, a cooling only operation mode will be described with reference to, for example, a case where a cooling load is generated in the load-side heat exchanger 26. In FIG. 2, the direction of flow of refrigerant is indicated by solid arrows.

Referring to FIG. 2, a low-temperature, low-pressure refrigerant is compressed by the compressor 10, and discharged from the compressor 10 as a high-temperature, high-pressure gas refrigerant. The high-temperature, high-pressure gas refrigerant discharged from the compressor 10 enters the heat source-side heat exchanger 12 via the refrigerant flow switching device 11. In the heat source-side heat exchanger 12, the refrigerant changes to a high-pressure liquid refrigerant while rejecting heat to the outdoor air supplied from the fan 16. After exiting the heat source-side heat exchanger 12, the high-pressure refrigerant exits the outdoor unit 1, and then passes through the main pipe 5 to enter the indoor unit 2.

In the indoor unit 2, the high-pressure refrigerant is expanded in the load-side expansion device 25, and changes to a low-temperature, low-pressure refrigerant that is in a gas-liquid two-phase state. The refrigerant in a gas-liquid two-phase state enters the load-side heat exchanger 26 serving as an evaporator, where the refrigerant removes heat from the indoor air, thus changing to a low-temperature, low-pressure gas refrigerant while cooling the indoor air. During this process, the opening degree of the load-side expansion device 25 is controlled by the controller 60 so as to maintain a constant level of superheat (degree of superheat), which is calculated as the difference between the temperature detected by the inlet-side temperature sensor 31 and the temperature detected by the outlet-side temperature sensor 32. The gas refrigerant exiting the load-side heat exchanger 26 passes through the main pipe 5 to enter the outdoor unit 1 again. The refrigerant entering the outdoor unit 1 passes through the refrigerant flow switching device 11 and the accumulator 19 before being sucked into the compressor 10 again.

(Overview of Necessity and Effect of Injection in Cooling Only Operation Mode)

If the refrigeration cycle of the air-conditioning apparatus 100 uses, for example, a refrigerant such as an R32 refrigerant whose temperature at discharge from the compressor 10 is higher than that of an R410A refrigerant (to be referred to as R410A hereinafter), it is necessary to lower the discharge temperature to prevent degradation of the refrigerating machine oil or burnout of the compressor 10. Accordingly, in cooling operation mode, a part of the high-pressure gas refrigerant exiting the compressor 10 is routed into the auxiliary heat exchanger 40 via the bypass pipe 41. After the refrigerant changes to a high-pressure subcooled liquid in the auxiliary heat exchanger 40 while rejecting heat to the outdoor air supplied from the fan 16, the resulting refrigerant enters the suction part of the compressor 10 via the flow regulating unit 42. As a result, the temperature of the refrigerant discharged from the compressor 10 can be lowered to ensure safe use.

(Control of Flow Regulating Unit 42)

The following describes how the flow regulating unit 42 is controlled by the controller 60 in cooling operation mode. The controller 60 controls the opening degree of the flow regulating unit 42 based on the discharge temperature of the compressor 10 detected by the discharge temperature sensor 43. That is, the discharge temperature of the compressor 10 drops when the amount of subcooled liquid refrigerant routed into the suction part of the compressor 10 from the auxiliary heat exchanger 40 is increased by increasing the opening degree (opening area) of the flow regulating unit 42. By contrast, the discharge temperature of the compressor 10 rises when the amount of subcooled liquid refrigerant routed into the suction part of the compressor 10 from the auxiliary heat exchanger 40 is decreased by decreasing the opening degree (opening area) of the flow regulating unit 42.

Accordingly, when the discharge temperature of the compressor 10 detected by the discharge temperature sensor 43 is equal to or lower than a discharge temperature threshold (for example, equal to or lower than 115 degrees C.) at which burnout of the compressor 10 or degradation of the refrigerating machine oil occurs, the controller 60 controls the flow regulating unit 42 to fully close. This cuts off the flow path of refrigerant entering the suction part of the compressor 10 from the auxiliary heat exchanger 40 via the bypass pipe 41. The discharge temperature threshold is set in accordance with the limit value of the discharge temperature of the compressor 10.

When the discharge temperature becomes higher than the discharge temperature threshold, the controller 60 controls the flow regulating unit 42 to open to allow the refrigerant subcooled in the auxiliary heat exchanger 40 to enter the suction part of the compressor 10. During this process, the controller 60 regulates the opening degree (opening area) of the flow regulating unit 42 such that the discharge temperature becomes equal to or lower than the discharge temperature threshold. For example, a table or mathematical expression associating discharge temperature with the opening degree of the flow regulating unit 42 is stored in the controller 60, and the controller 60 controls the opening degree of the flow regulating unit 42 based on the discharge temperature. Then, a low-pressure, low-temperature gas refrigerant exiting the accumulator 19, and the liquid refrigerant subcooled in the auxiliary heat exchanger 40 mix together, resulting in a low-pressure, gas-liquid two-phase refrigerant at a high quality. This refrigerant is then sucked from the suction part of the compressor 10.

Further, the controller 60 controls the opening degree of the flow regulating unit 42 in an auxiliary manner based on the degree of refrigerating machine oil superheat, which represents the difference between the temperature of refrigerating machine oil detected by the refrigerating machine oil temperature sensor 44 and the evaporating temperature calculated by using the low-side pressure detected by the low-side pressure sensor 45. That is, the degree of refrigerating machine oil superheat in the compressor 10 drops when the amount of subcooled liquid refrigerant routed into the suction part of the compressor 10 from the auxiliary heat exchanger 40 is increased by increasing the opening degree (opening area) of the flow regulating unit 42. By contrast, the discharge temperature of the compressor 10 rises when the amount of subcooled liquid refrigerant routed into the suction part of the compressor 10 from the auxiliary heat exchanger 40 is decreased by decreasing the opening degree (opening area) of the flow regulating unit 42.

Accordingly, when the degree of refrigerating machine oil superheat in the compressor 10 detected and calculated by using the refrigerating machine oil temperature sensor 44 and the low-side pressure sensor 45 is equal to or higher than a threshold degree of refrigerating machine oil superheat (for example, equal to or higher than 10 degrees C.), the controller 60 performs control based solely on discharge temperature. The threshold degree of refrigerating machine oil superheat is set in accordance with the limit value of the degree of refrigerating machine oil superheat in the compressor 10.

When the degree of refrigerating machine oil superheat becomes lower than the threshold degree of refrigerating machine oil superheat, the controller 60 controls the flow regulating unit 42 to fully close. This cuts off the flow path of refrigerant entering the suction part of the compressor 10 from the auxiliary heat exchanger 40 via the bypass pipe 41. At this time, the discharge temperature rises. Accordingly, the controller 60 causes the rotational speed of the compressor 10 to be lowered so that the discharge temperature becomes equal to or less than the discharge temperature threshold.

(Injection and Effect of Injection in Cooling Operation Mode)

As described above, the refrigerant enters the suction part of the compressor 10 with its enthalpy at the inlet of the compressor 10 reduced, thus making it possible to limit an excessive rise in the discharge temperature of the compressor 10. As a result, degradation of the refrigerating machine oil can be minimized to prevent damage to the compressor 10. This ensures the reliability of the system even when an inexpensive compressor is used rather than a compressor having a special structure. Further, limiting of an excessive rise in the discharge temperature of the compressor 10 allows for an increase in the rotation speed of the compressor 10 to ensure sufficient heating capacity, thus minimizing a decrease in user comfort.

Furthermore, in cooling operation mode, the controller 60 causes a part of the high-pressure refrigerant exiting the compressor 10 to be subcooled in the auxiliary heat exchanger 40, thus ensuring that the refrigerant entering the flow regulating unit 42 be in a liquid state. This configuration prevents refrigerant from entering the flow regulating unit 42 in a two-phase state. This prevents noise from being generated in the flow regulating unit 42, and also prevents the control of discharge temperature of the compressor 10 by the flow regulating unit 42 from becoming unstable.

[Heating Only Operation Mode]

Figure 3:
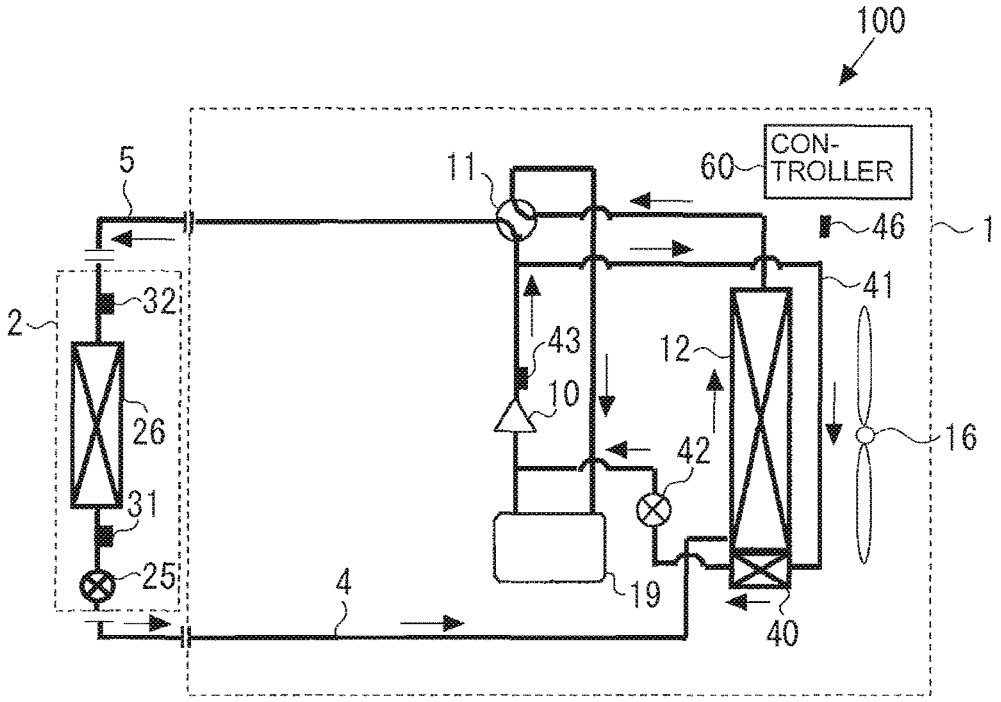
FIG. 3 is a refrigerant circuit diagram illustrating the flow of refrigerant in heating operation mode of the air-conditioning apparatus according to Embodiment 1 of the present invention.

FIG. 3 is a refrigerant circuit diagram illustrating the flow of refrigerant in heating operation mode of the air-conditioning apparatus 100. In FIG. 3, a heating only operation mode will be described with reference to, for example, a case where a heating load is generated in the load-side heat exchanger 26. In FIG. 3, the direction of flow of refrigerant is indicated by solid arrows.

Referring to FIG. 3, a low-temperature, low-pressure refrigerant is compressed by the compressor 10, and discharged from the compressor 10 as a high-temperature, high-pressure gas refrigerant. The high-temperature, high-pressure gas refrigerant discharged from the compressor 10 passes through the refrigerant flow switching device 11 before exiting the outdoor unit 1. The high-temperature, high-pressure gas refrigerant exiting the outdoor unit 1 passes through the main pipe 5, and as the refrigerant rejects heat to the indoor air in the load-side heat exchanger 26, the refrigerant changes to a liquid refrigerant while heating the indoor space. The liquid refrigerant exiting the load-side heat exchanger 26 is expanded in the load-side expansion device 25, causing the refrigerant to change to a low-temperature, low-pressure refrigerant that is in a gas-liquid two-phase state. This refrigerant then passes through the main pipe 5 to enter the outdoor unit 1 again. After entering the outdoor unit 1, the low-temperature, low-pressure refrigerant in a gas-liquid two-phase state enters the heat source-side heat exchanger 12. In the heat source-side heat exchanger 12, the low-temperature, low-pressure refrigerant in a gas-liquid two-phase state changes to a low-temperature, low-pressure gas refrigerant while removing heat from the outdoor air, and then passes through the refrigerant flow switching device 11 and the accumulator 19 before being sucked into the compressor 10 again.

(Overview of Necessity and Effect of Injection in Heating Operation Mode)

As in cooling operation mode mentioned above, in heating operation mode, when the refrigerant used is, for example, a refrigerant that is discharged from the compressor 10 at a high temperature, such as R32, it is necessary to lower the discharge temperature to prevent degradation of the refrigerating machine oil or burnout of the compressor 10. Accordingly, in heating operation mode, a part of the high-pressure gas refrigerant discharged from the compressor 10 is routed into the auxiliary heat exchanger 40 via the bypass pipe 41. Then, in the auxiliary heat exchanger 40, the refrigerant changes to a high-pressure subcooled liquid while rejecting heat to the outdoor air supplied from the fan 16, and the subcooled liquid refrigerant is routed into the suction part of the compressor 10 via the flow regulating unit 42. As a result, the temperature of the refrigerant discharged from the compressor 10 can be lowered to ensure safe use.

(Control of Flow Regulating Unit 42)

The following describes how the flow regulating unit 42 is controlled by the controller 60 in heating operation mode. The controller 60 controls the opening degree of the flow regulating unit 42 based on the discharge temperature of the compressor 10 detected by the discharge temperature sensor 43. That is, the discharge temperature of the compressor 10 drops when the amount of subcooled liquid refrigerant routed into the suction part of the compressor 10 from the auxiliary heat exchanger 40 is increased by increasing the opening degree (opening area) of the flow regulating unit 42. By contrast, the discharge temperature of the compressor 10 rises when the amount of subcooled liquid refrigerant routed into the suction part of the compressor 10 from the auxiliary heat exchanger 40 is decreased by decreasing the opening degree (opening area) of the flow regulating unit 42.

Accordingly, when the discharge temperature of the compressor 10 detected by the discharge temperature sensor 43 is equal to or lower than a discharge temperature threshold (for example, equal to or lower than 115 degrees C.) at which burnout of the compressor 10 or degradation of the refrigerating machine oil occurs, the controller 60 controls the flow regulating unit 42 to fully close. This cuts off the flow path of refrigerant entering the suction part of the compressor 10 from the auxiliary heat exchanger 40 via the bypass pipe 41.

Now, consider a case where, for example, the outdoor unit 1 is installed in a low-temperature environment, and the indoor unit 2 is installed in a high temperature environment in heating operation mode. This situation leads to an increased compression ratio, which is the ratio between the high pressure at the discharge part of the compressor 10 and the low pressure at the suction part of the compressor 10, causing an excessive rise in the discharge temperature of the compressor 10. When the discharge temperature becomes higher than a discharge temperature threshold, the controller 60 controls the flow regulating unit 42 to open so that the refrigerant routed through the auxiliary heat exchanger 40 flows to the suction part of the compressor 10. During this process, the controller 60 regulates the opening degree (opening area) of the flow regulating unit 42 such that the discharge temperature becomes equal to or lower than the discharge temperature threshold. For example, a table or mathematical expression associating discharge temperature with the opening degree of the flow regulating unit 42 is stored in the controller 60, and the controller 60 controls the opening degree of the flow regulating unit 42 based on the discharge temperature. The discharge temperature threshold is set in accordance with the limit value of the discharge temperature of the compressor 10.

Then, heat exchange takes place in the auxiliary heat exchanger 40 between the air supplied from the fan 16, and a high-pressure gas refrigerant that is at a saturation temperature higher than the temperature of air, resulting in a subcooled high-pressure liquid refrigerant. The resulting refrigerant is then routed into the suction part of the compressor 10 via the flow regulating unit 42. At this time, a low-pressure, low-temperature gas refrigerant exiting the accumulator 19, and the liquid refrigerant cooled in the auxiliary heat exchanger 40 mix together, resulting in a low-pressure refrigerant that is in a gas-liquid two-phase refrigerant and at a high quality. That is, the refrigerant enters the compressor 10 with its enthalpy at the inlet of the compressor 10 reduced, thus allowing an excessive rise in the discharge temperature of the compressor 10 to be limited. This makes it possible to minimize degradation of the refrigerating machine oil and therefore damaging to the compressor 10.

Further, the controller 60 controls the opening degree of the flow regulating unit 42 based on the degree of refrigerating machine oil superheat, which represents the difference between the temperature of refrigerating machine oil detected by the refrigerating machine oil temperature sensor 44 and the evaporating temperature calculated by using the low-side pressure detected by the low-side pressure sensor 45. That is, the degree of refrigerating machine oil superheat in the compressor 10 drops when the amount of subcooled liquid refrigerant routed into the suction part of the compressor 10 from the auxiliary heat exchanger 40 is increased by increasing the opening degree (opening area) of the flow regulating unit 42. By contrast, the discharge temperature of the compressor 10 rises when the amount of subcooled liquid refrigerant routed into the suction part of the compressor 10 from the auxiliary heat exchanger 40 is decreased by decreasing the opening degree (opening area) of the flow regulating unit 42.

Accordingly, when the degree of refrigerating machine oil superheat in the compressor 10 detected and calculated by using the refrigerating machine oil temperature sensor 44 and the low-side pressure sensor 45 is equal to or higher than a threshold degree of refrigerating machine oil superheat (for example, equal to or higher than 10 degrees C.), the controller 60 performs control based solely on discharge temperature. The threshold degree of refrigerating machine oil superheat is set in accordance with the limit value of the degree of refrigerating machine oil superheat in the compressor 10.

When the degree of refrigerating machine oil superheat becomes lower than the threshold degree of refrigerating machine oil superheat, the controller 60 controls the flow regulating unit 42 to fully close. This cuts off the flow path of refrigerant entering the suction part of the compressor 10 from the auxiliary heat exchanger 40 via the bypass pipe 41. At this time, the discharge temperature rises. Accordingly, the controller 60 causes the rotational speed of the compressor 10 to be lowered so that the discharge temperature becomes equal to or less than the discharge temperature threshold.

In the air-conditioning apparatus 100, a first flow path opening and closing device capable of full closing may be provided at the inlet side of the auxiliary heat exchanger 40. In situations such as when there is no need to limit an excessive rise in the discharge temperature of the compressor 10, the controller 60 may control the first flow path opening and closing device and the opening and closing device 47 to close, and control the flow regulating unit 42 to a small opening degree just short of full closure. This configuration can minimize stagnation of refrigeration in the bypass pipe 41 and the auxiliary heat exchanger 40. When a necessity arises to limit an excessive rise in the discharge temperature of the compressor 10, the above configuration prevents an excessive amount of liquid refrigerant from flowing into the suction part of the compressor 10 from the flow regulating unit 42, thus preventing damage to the compressor 10 due to excessive liquid return to the compressor 10.

(Effect of Injection in Heating Operation Mode)

As described above, in heating operation mode, a part of the medium-pressure, medium-temperature refrigerant entering the outdoor unit 1 from the indoor unit 2 is changed to a subcooled liquid in the auxiliary heat exchanger 40, and the subcooled liquid is routed into the suction part of the compressor 10 to limit a rise in the discharge temperature of the compressor 10. This arrangement allows whole part of the high-pressure, high-temperature gas refrigerant discharged from the compressor 10 to be supplied to the indoor unit 2. This ensures the reliability of the system even when an inexpensive compressor is used rather than a compressor having a special structure. Further, limiting of an excessive rise in the discharge temperature of the compressor 10 allows for an increase in the rotation speed of the compressor 10 to ensure sufficient heating capacity, thus minimizing a decrease in user comfort.

(Selection of Size of Auxiliary Heat Exchanger)

For stable control of the flow regulating unit 42, the refrigerant exiting the auxiliary heat exchanger 40 needs to be liquefied reliably. For that reason, a consideration needs to be given to the heat transfer area of the auxiliary heat exchanger 40. A conceivable environment that necessitates limiting of a rise in the discharge temperature of the compressor 10 in heating operation mode is when the outdoor unit 1 is installed under an environment of low temperature (for example, at an environmental temperature of −10 degrees C. or lower). This leads to a large difference between the saturation temperature of the high-pressure, high-temperature gas refrigerant that needs to be subcooled in the auxiliary heat exchanger 40, and the environmental temperature, thus allowing for sufficient subcooling even if the auxiliary heat exchanger 40 has a small heat transfer area.

A conceivable environment that necessitates limiting of a rise in the discharge temperature of the compressor 10 in cooling operation mode is when the outdoor unit 1 is installed under an environment of high temperature (for example, at an environmental temperature of 40 degrees C. or higher). Under this environment, the difference between the saturation temperature of the high-pressure, high-temperature gas refrigerant that needs to be subcooled in the auxiliary heat exchanger 40, and the environmental temperature is small. Thus, for sufficient subcooling to occur in the auxiliary heat exchanger 40, the heat transfer area of the auxiliary heat exchanger 40 needs to be increased than that in heating operation mode.

Thus, the heat transfer area of the auxiliary heat exchanger 40 may be selected to achieve a condition that maximizes the amount of subcooled liquid entering the suction part of the compressor 10 during the injection process in cooling operation mode. This condition depends on the environmental temperature at which the air-conditioning apparatus 100 can be operated. In this regard, the condition that gives the greatest difference between the pressure of refrigerant cooled in the heat source-side heat exchanger 12 and the pressure of refrigerant heated in the load-side heat exchanger 26 is the condition that causes the greatest rise in the temperature of the high-pressure, high-temperature refrigerant discharged from the compressor 10.

Accordingly, the heat transfer area of the auxiliary heat exchanger 40 is determined assuming the environment under which the rise in the temperature of high-pressure, high-temperature refrigerant discharged from the compressor 10 becomes greatest. For example, assuming that the environmental temperature at which the air-conditioning apparatus 100 can be operated is such that the maximum value of the environmental temperature at which the outdoor unit 1 is installed is 43 degrees C., and the minimum value of the environmental temperature at which the indoor unit 2 is installed is 15 degrees C., this environment corresponds to the condition that causes the greatest rise in the temperature of refrigerant discharged from the compressor 10. The heat transfer area of the auxiliary heat exchanger 40 is determined for this condition.

First, in cooling operation mode, assuming that the maximum environmental temperature at which the outdoor unit 1 is installed is 43 degrees C., and the minimum environmental temperature at which the indoor unit 2 is installed is 15 degrees C., the flow rate (the amount of injection) of the subcooled liquid refrigerant that needs to be routed into the suction part of the compressor 10 from the auxiliary heat exchanger 40 to make the temperature of refrigerant discharged from the compressor 10 equal to or lower than a discharge temperature threshold (for example, equal to or lower than 115 degrees C.), may be calculated from the energy conversation law as represented by Equation (1).

[Eq. 1]

$$Gr_1h_1+Gr_2h_2=Grh \quad (1)$$

In Equation (1), $Gr_1$ (kg/h) and $h_1$ (kJ/kg) respectively denote the flow rate and enthalpy of the low-temperature, low-pressure gas refrigerant that enters the suction part of the compressor 10 from the accumulator 19; $Gr_2$ (kg/h) and $h_2$ (kJ/kg) respectively denote the flow rate and enthalpy of the low-temperature, low-pressure liquid refrigerant routed from the auxiliary heat exchanger 40 to the suction part of the compressor 10 via the flow regulating unit 42 and the bypass pipe 41; and Gr (kg/h) and h (kJ/kg) respectively denote the total refrigerant flow rate after the two streams of refrigerant merge at the suction part of the compressor 10, and the enthalpy after merging.

The enthalpy after merging, h (kJ/kg), which is calculated using Equation (1), is less than the enthalpy $h_1$ (kJ/kg) of the low-temperature, low-pressure gas refrigerant that enters the suction part of the compressor 10 from the accumulator 19. Consequently, the temperature of refrigerant discharged from the compressor 10 is lower when refrigerant is routed from the auxiliary heat exchanger 40 than when there is no inflow of liquid refrigerant from the auxiliary heat exchanger 40.

Now, suppose that for both a case where the refrigerant is compressed to a predetermined pressure from the enthalpy $h_1$ (kJ/kg) with the flow regulating unit 42 fully closed, and a case where the refrigerant is compressed to a predetermined pressure when the flow regulating unit 42 is open and a liquid is routed from the bypass pipe 41, the refrigerant is compressed to the same pressure with an equivalent adiabatic efficiency and by an equivalent displacement. Linder this condition, the refrigerant flow rate $Gr_2$ at which the temperature of gas refrigerant discharged from the compressor 10 becomes equal to or less than a discharge temperature threshold (for example, equal to or lower than 115 degrees C.) is derived from Equation (1).

Next, letting Q1 (W) be the amount of heat exchange in the auxiliary heat exchanger 40, and $h_3$ (kJ/kg) be the enthalpy of the high-pressure, high-temperature refrigerant discharged from the compressor 10 in cooling operation mode, which is also the enthalpy of the refrigerant at the inlet side of the auxiliary heat exchanger 40, the general form of the equation defining the amount of heat exchange due to a change in enthalpy represented by Equation (2) holds.

[Eq. 2]

$$Q1=Gr_2\times(h_3-h_2) \tag{2}$$

Further, the amount of heat exchange in the auxiliary heat exchanger 40, Q1 (W), can be represented by Equation (3) below, which is the general form of the equation defining the amount of heat exchange due to heat transmission, where A1 ($m^2$) is the area of contact of the auxiliary heat exchanger 40 with the air of the environment under which the outdoor unit 1 is installed (to be referred to as total heat transfer area hereinafter), k ($W/(m^2\cdot K)$) is the overall heat transmission coefficient based on the side where the fins used in the auxiliary heat exchanger 40 and the outer surface of the heat transfer tubes contact the air of the environment in the installation location (to be referred to as "based on the tube's outer side" hereinafter), which represents the ease with which heat is transmitted owing to the difference in temperature between refrigerant and air, and ΔTm (K or degrees C.) is the logarithmic mean temperature difference, which represents the temperature difference between refrigerant and air at each of the inlet and outlet of the auxiliary heat exchanger 40, with variations of temperature in the direction of flow taken into account.

[Eq. 3]

$$Q1=A1\times k\times\Delta Tm \tag{3}$$

The overall heat transmission coefficient k based on the tube's outer side varies with changes in heat transfer coefficient due to changes in, for example, the specifications of the heat transfer tubes used in the auxiliary heat exchanger 40, which is a plate fin-tube heat exchanger, fin geometry, fan air velocity, refrigeration cycle, or the operating state of the refrigeration cycle. For example, the overall heat transmission coefficient k is given to be approximately 72 ($W/(m^2\cdot K)$), which is a value for the condenser obtained by the results of a large number of tests for cooling operation mode.

Assuming that the auxiliary heat exchanger 40 employs the counterflow arrangement for heat exchange with air, the logarithmic mean temperature difference ΔTm (K or degrees C.) can be calculated by Equation (4) below, where Tc (K or degrees C.) is the saturation temperature of refrigerant, T1 is the temperature of air entering the auxiliary heat exchanger 40, and T2 (K or degrees C.) is the temperature of air exiting the auxiliary heat exchanger 40.

[Eq. 4]

$$\Delta Tm=\frac{(Tc-T2)-(Tc-T1)}{\ln\left(\frac{Tc-T2}{Tc-T1}\right)} \tag{4}$$

The total heat transfer area A1 of the auxiliary heat exchanger 40 can be calculated by using Equations (1) to (4) above. For example, the following describes how the total heat transfer area A1 is calculated for the air-conditioning apparatus 100 having equivalent to 10 horsepower that uses an R32 refrigerant as the refrigerant. For the air-conditioning apparatus 100 mentioned above, under the condition that the outdoor unit 1 is installed at an environmental temperature of approximately 43 degrees C., and the indoor unit 2 is installed at an environmental temperature of approximately 15 degrees C., the total refrigerant flow rate Gr ($=Gr_1+Gr_2$) in Equation (1) is approximately 340 (kg/h). Further, the saturation temperature of refrigerant discharged from the compressor 10 is, for example, 54 degrees C., and an enthalpy $h_3$ of the saturated gas at 54 degrees C. is approximately 503 (kJ/kg). Suppose that, for the saturated gas at 54 degrees C. to be sufficiently subcooled by exchanging heat with air at approximately 43 degrees C. in the auxiliary heat exchanger 40, approximately 5 degrees C. is to be provided as a degree of subcooling representing the difference in temperature between the saturated liquid at 54 degrees C. and the liquid refrigerant at the outlet side of the auxiliary heat exchanger 40. In this case, an enthalpy $h_2$ at the output of the auxiliary heat exchanger 40 is determined to be approximately 296 (kJ/kg), from the temperature of the saturated liquid at the inlet side of 54 degrees C. and the temperature of the liquid refrigerant at the outlet of the auxiliary heat exchanger 40. Further, assuming that the temperature of saturated gas at the suction part of the compressor 10 is approximately zero degrees C., the enthalpy $h_1$ of refrigerant entering the suction part of the compressor 10 from the accumulator 19 is obtained as enthalpy $h_1$=approximately 515 (kJ/kg).

In this way, the total refrigerant flow rate Gr and the enthalpies $h_1$ and $h_2$ in Equation (1) are determined based on factors such as the conditions under which the air-conditioning apparatus 100 can be operated. When refrigerant is to be compressed to a pressure corresponding to 54 degrees C. representing the saturation temperature of refrigerant in the heat source-side heat exchanger 12, the refrigerant flow rate $Gr_2$ required to make the discharge temperature of the compressor 10 equal to or lower than a first predetermined value (equal to or lower than 115 degrees C.) is determined from Equation (1) to be approximately 12 (kg/h).

Next, as described above, if the saturation temperature of refrigerant discharged from the compressor 10 is, for example, 54 degrees C., the enthalpy $h_3$ of the saturated gas at 54 degrees C. is approximately 503 (kJ/kg). Therefore, the amount of heat exchange Q1 required for the auxiliary heat exchanger 40 is determined to be approximately 690 (W) by substituting the refrigerant flow rate $Gr_2$ and the enthalpies $h_2$ and $h_3$ into Equation (2).

Further, suppose that the saturation temperature Tc of refrigerant discharged from the compressor 10 is approximately 54 (degrees C.), and the temperature T1 of air entering the auxiliary heat exchanger 40 is 43 (degrees C.). As for the temperature T2 of air exiting the auxiliary heat exchanger 40, owing to the large amount of heat exchange Q1 in the auxiliary heat exchanger 40 of approximately 690 (W), it is assumed that the temperature of air rises to a temperature substantially equal to the saturation temperature of refrigerant, by about 10 degrees C. from the temperature of incoming air, and thus the temperature T2 is given to be 53 (degrees C.). In this case, the logarithmic mean temperature difference is determined from Equation (4) to be approximately 4.17 (degrees C.), and the total heat transfer area A1 required for the auxiliary heat exchanger 40 is determined from Equation (3) to be approximately 2.298 ($m^2$).

When an R32 refrigerant is used for the air-conditioning apparatus 100 equivalent to 10 horsepower, the total heat transfer area A2 required for the heat source-side heat exchanger 12 is approximately 141 ($m^2$). When the auxiliary heat exchanger 40 constitutes a part of the heat source-side heat exchanger 12, the ratio A1/(A1+A2), which is the ratio of the total heat transfer area A1 of the auxiliary heat exchanger 40 to the sum of the total heat transfer area A2 required for the heat source-side heat exchanger 12 and the total heat transfer area A1 required for the auxiliary heat exchanger 40, is determined as 2.298/141.644 to be equal to or higher than approximately 1.62%.

Although the total heat transfer area A1 of the auxiliary heat exchanger 40 is calculated above for, by way of example, the air-conditioning apparatus 100 equivalent to 10 horsepower under a predetermined condition in which the air-conditioning apparatus 100 can be operated, this is not to be construed in a limiting sense. For example, suppose that the air-conditioning apparatus 100 is configured such that even when the required cooling or heating capacity (horsepower) changes, the operating state of high-pressure/low-pressure refrigerant remains substantially unchanged with respect to the environmental temperature at which each of the outdoor unit 1 and the indoor unit 2 is installed. In this case, the cooling or heating capacity (horsepower) changes only with a change in the displacement of the compressor 10 (a change in total refrigerant flow rate Gr (kg/h)). Accordingly, the refrigerant flow rate $Gr_2$ of refrigerant routed into the auxiliary heat exchanger 40 may be made to vary with the rate of change in the displacement of the compressor 10, and the total heat transfer area A1 of the auxiliary heat exchanger 40 may be calculated from Equation (2) and Equation (3).

For example, the displacement of the compressor 10 required for the air-conditioning apparatus 100 having equivalent to 14 horsepower is approximately 1.4 times greater than that required for an air-conditioning apparatus having equivalent to 10 horsepower. Thus, the flow rate $Gr_2$ of refrigerant routed into the auxiliary heat exchanger 40 is approximately 16.8 (kg/h) (=10-horsepower-equivalent $Gr_2$ of 12 (kg/h)×1.4). Assuming that the enthalpy of refrigerant at each of the inlet and outlet of the auxiliary heat exchanger 40 is substantially equal to that for the air-conditioning apparatus 100 having equivalent to 10 horsepower, the amount of heat exchange Q1 in the auxiliary heat exchanger 40 is determined from Equation (2) to be approximately 996 (W). Since the overall heat transmission coefficient k and the logarithmic mean temperature difference ΔTm can be also regarded as substantially equal to those for the air-conditioning apparatus 100 equivalent to 10 horsepower, the total heat transfer area A1 required for the auxiliary heat exchanger 40 is determined from Equation (3) to be 3.217 ($m^2$), which is approximately 1.4 times the total heat transfer area A1 of the auxiliary heat exchanger 40 for the air-conditioning apparatus equivalent to 10 horsepower. Likewise, assuming that the cooling or heating capacity (horsepower) changes only with a change in the displacement of the compressor 10 (a change in total refrigerant flow rate Gr (kg/h)), the total heat transfer area A2 required for the heat source-side heat exchanger 12 can be also regarded as approximately 1.4 times greater than that required for the air-conditioning apparatus equivalent to 10 horsepower. That is, irrespective of the horsepower of the air-conditioning apparatus 100, the ratio A1/(A1+A2), which is the ratio of the total heat transfer area A1 of the auxiliary heat exchanger 40 to the sum of the total heat transfer area A2 required for the heat source-side heat exchanger 12 and the total heat transfer area A1 required for the auxiliary heat exchanger 40, is equal to or higher than approximately 1.62%.

If a part of the heat source-side heat exchanger 12 is used as the auxiliary heat exchanger 40, for example, situations may arise where it is not possible to increase the number of stages for the heat source-side heat exchanger 12, owing to factors such as a constraint with respect to the direction of height of the outdoor unit 1. If the auxiliary heat exchanger 40 constituting a part of the heat source-side heat exchanger 12 has an excessively large size in this case, the total heat transfer area A1 of the heat source-side heat exchanger 12 decreases, resulting in deterioration of the performance of the heat source-side heat exchanger 12.

Figure 4:
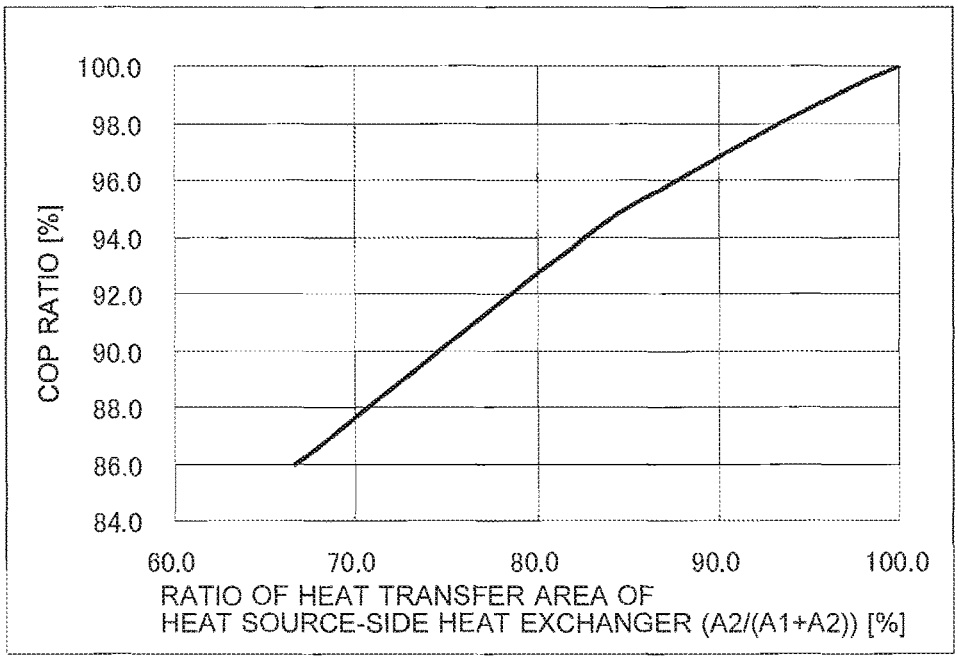
FIG. 4 is a graph illustrating the relationship between the ratio of the heat transfer area of a heat source-side heat exchanger to the sum of the heat transfer area of the heat source-side heat exchanger and the heat transfer area of an auxiliary heat exchanger in the air-conditioning apparatus according to Embodiment 1 of the present invention, and COP, which is an index of the performance of the air-conditioning apparatus.

FIG. 4 is a graph illustrating the relationship between the ratio of the heat transfer area of the heat source-side heat exchanger 12 to the sum of the total heat transfer area A2 of the heat source-side heat exchanger 12 and the total heat transfer area A1 of the auxiliary heat exchanger 40 in the air-conditioning apparatus 100, and COP, which is an index of the performance of the air-conditioning apparatus 100. As illustrated in FIG. 4, to keep the decrease in COP within approximately 1.5%, the ratio A2/(A1+A2) of the total heat transfer area A2 of the heat source-side heat exchanger 12 to the sum A1+A2 of the total heat transfer areas needs to be approximately 95%. This means that the corresponding ratio A1/(A1+A2) for the total heat transfer area A1 of the auxiliary heat exchanger 40 is equal to or less than 5%. Thus, it is desirable that the ratio A1/(A1+A2) of the total heat transfer area A1 of the auxiliary heat exchanger 40 to the sum A1+A2 of the total heat transfer areas be equal to or less than approximately 5%. However, if the auxiliary heat exchanger 40 is installed not as a part of the heat source-side heat exchanger 12 but independently from the heat source-side heat exchanger 12, there is no need to keep the ratio A1/(A1+A2) within approximately 5%. In this case, the ratio A1/(A1+A2) may be any value equal to or higher than approximately 1.62%.

Embodiment 2

Figure 5:
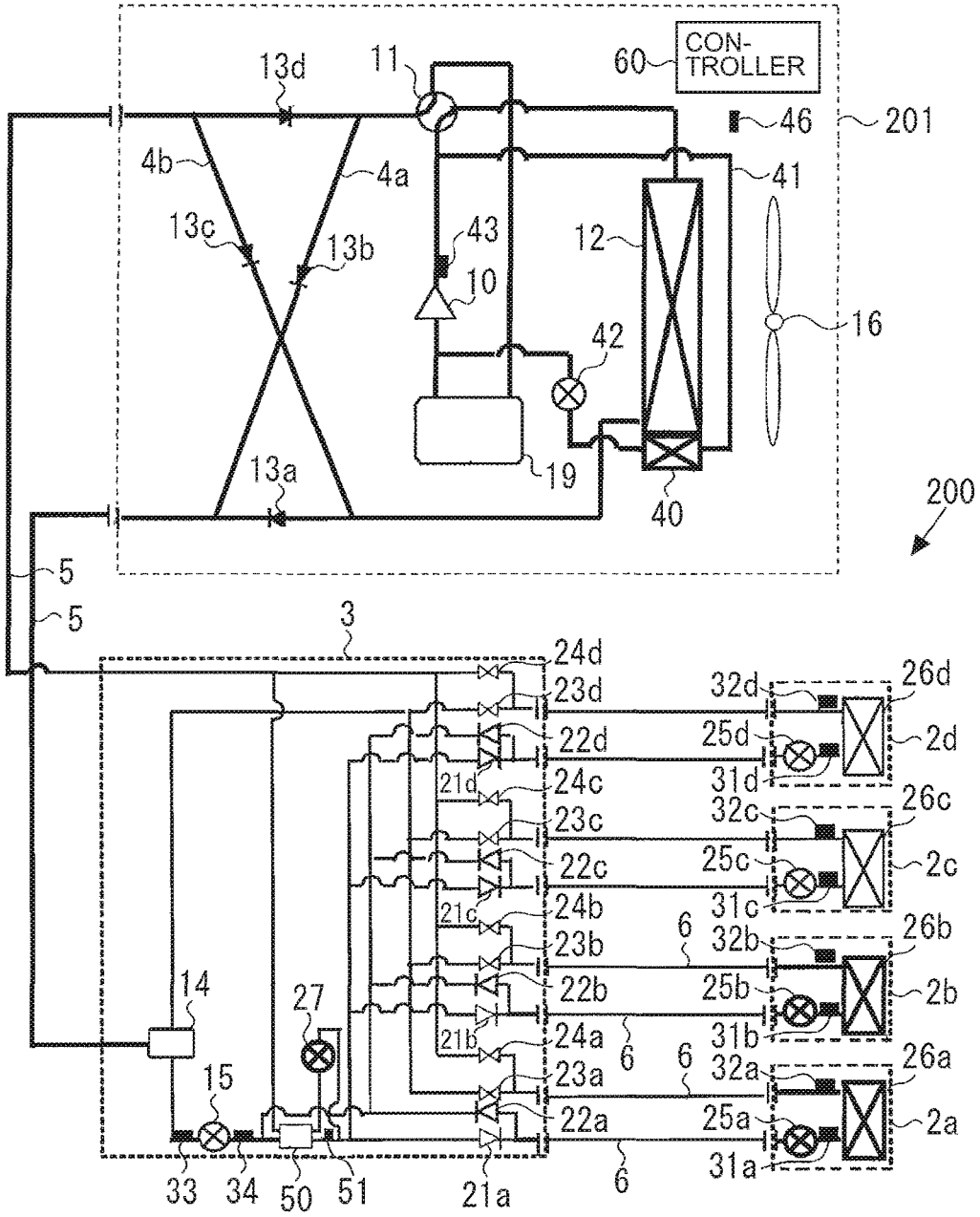
FIG. 5 is a refrigerant circuit diagram illustrating an exemplary circuit configuration of an air-conditioning apparatus according to Embodiment 2 of the present invention.

FIG. 5 is a refrigerant circuit diagram illustrating an exemplary circuit configuration of an air-conditioning apparatus according to Embodiment 2 of the present invention. An air-conditioning apparatus 200 will be described below with reference to FIG. 5. In FIG. 5, parts configured in the same manner as those in the air-conditioning apparatus 100 illustrated in FIG. 1 will be denoted by the same reference signs to omit a description of these parts.

The air-conditioning apparatus 200 illustrated in FIG. 5 has a single outdoor unit 201, which is a heat source unit, a plurality of indoor units 2*a* to 2*d*, and a relay device 3 with an opening and closing device provided between the outdoor unit 201 and each of the indoor units 2*a* to 2*d*. The outdoor unit 201 and the relay device 3 are connected by the main pipe 5 through which refrigerant flows, and the relay device 3 and the indoor units 2*a* to 2*d* are connected by a branch pipe 6 through which refrigerant flows. The cooling energy or heating energy generated by the outdoor unit 1 is routed through each of the indoor units 2*a* to 2*d* via the relay device 3.

The outdoor unit 201 and the relay device 3 are connected by using two main pipes 5, and the relay device 3 and each of the indoor units 2 are connected by two branch pipes 6. Using two pipes to connect the outdoor unit 201 with the relay device 3, and each of the indoor units 2*a* to 2*d* with the relay device 3 in this way allows for easy installation.

[Outdoor Unit 201]

As in Embodiment 1, in the outdoor unit 201, the compressor 10, the refrigerant flow switching device 11, the heat source-side heat exchanger 12, the auxiliary heat exchanger 40, the flow regulating unit 42, the bypass pipe 41, and the accumulator 19 are connected by the refrigerant pipe 4, and are mounted together with the fan 16, which is a blower device.

Further, the outdoor unit 201 has a first connecting pipe 4*a*, a second connecting pipe 4*b*, and first backflow prevention devices 13*a* to 13*d* implemented by check valves or other devices. The first backflow prevention device 13*a* prevents a high-temperature, high-pressure gas refrigerant from flowing backward from the first connecting pipe 4*a* to the heat source-side heat exchanger 12 in heating only operation mode and heating main operation mode. The first backflow prevention device 13*b* prevents a high-pressure refrigerant that is in a liquid or gas-liquid two-phase state from flowing backward from the first connecting pipe 4*a* to the accumulator 19 in cooling only operation mode and cooling main operation mode. The first backflow prevention device 13*c* prevents a high-pressure refrigerant that is in a liquid or gas-liquid two-phase state from flowing backward from the first connecting pipe 4*a* to the accumulator 19 in cooling only operation mode and cooling main operation mode. The first backflow prevention device 13*d* prevents a high-temperature, high-pressure gas refrigerant from flowing backward from the flow path on the discharge side of the compressor 10 to the second connecting pipe 4*b* in heating only operation mode and heating main operation mode.

The provision of the first connecting pipe 4*a*, the second connecting pipe 4*b*, and the first backflow prevention devices 13*a* to 13*d* allows the refrigerant routed into the relay device 3 to flow in a fixed direction irrespective of the operation required by the indoor unit 2. Although the first backflow prevention devices 13*a* to 13*d* are illustrated to be implemented by check valves, their configuration is not limited as long as backflow of refrigerant can be prevented. As such, the first backflow prevention devices 13*a* to 13*d* may be implemented by opening and closing devices, or expansion devices capable of full closing.

[Indoor Units 2*a* to 2*d*]

The indoor units 2*a* to 2*d* have, for example, the same configuration, and respectively include load-side heat exchangers 26*a* to 26*d*, and load-side expansion devices 25*a* to 25*d*. The load-side heat exchangers 26*a* to 26*d* are each connected to the outdoor unit 201 via the branch pipe 6, the relay device 3, and the main pipe 5. The load-side heat exchangers 26*a* to 26*d* allow heat to be exchanged between air supplied from a blower device such as a fan (not illustrated), and refrigerant to thereby generate the heating air or cooling air to be supplied to the indoor space. The load-side expansion devices 25*a* to 25*d* are each implemented by, for example, a device with a variable opening degree, such as an electronic expansion valve. The load-side expansion devices 25*a* to 25*d* each function as a pressure reducing valve or expansion valve to cause refrigerant to be reduced in pressure and expand. The load-side expansion devices 25*a* to 25*d* are located upstream of the load-side heat exchangers 26*a* to 26*d* with respect to the flow of refrigerant in cooling only operation mode.

The indoor units 2 are provided with inlet-side temperature sensors 31*a* to 31*d* that each detect the temperature of refrigerant entering the corresponding load-side heat exchanger 26, and outlet-side temperature sensors 32*a* to 32*d* that each detect the temperature of refrigerant exiting the corresponding load-side heat exchanger 26. The inlet-side temperature sensors 31*a* to 31*d* and the outlet-side temperature sensors 32*a* to 32*d* are implemented by, for example, thermistors or other sensors, and the detected inlet-side temperatures and outlet-side temperatures of the load-side heat exchangers 26*a* to 26*d* are sent to the controller 60.

Although four indoor units 2 are connected to the outdoor unit 201 via the relay device 3 and the refrigerant pipe 4 in FIG. 5, the number of indoor units 2 connected is not limited to four but may be any number equal to or greater than two.

[Relay Device 3]

The relay device 3 has a gas-liquid separator 14, a refrigerant-to-refrigerant heat exchanger 50, a third expansion device 15, a fourth expansion device 27, a plurality of first opening and closing devices 23*a* to 23*d*, a plurality of second opening and closing devices 24*a* to 24*d*, a plurality of second backflow prevention devices 21*a* to 21*d*, which are backflow prevention devices such as check valves, and a plurality of third backflow prevention devices 22*a* to 22*d*, which are backflow prevention devices such as check valves.

The gas-liquid separator 14 has the following function. In cooling and heating mixed operation mode when there is a large cooling load, the gas-liquid separator 14 separates a high-pressure, gas-liquid two-phase refrigerant generated in the outdoor unit 201 into a liquid and a gas, of which the liquid is routed into the pipe located on the lower side in FIG. 5 to supply cooling energy to the indoor unit 2, and the gas is routed into the pipe located on the upper side in FIG. 5 to supply heating energy to the indoor unit 2. The gas-liquid separator 14 is installed at the inlet of the relay device 3.

The refrigerant-to-refrigerant heat exchanger 50 is implemented by, for example, a double-pipe heat exchanger or a plate heat exchanger. In cooling only operation mode, cooling main operation mode, and heating main operation mode, the refrigerant-to-refrigerant heat exchanger 50 allows heat to be exchanged between a high-pressure or medium-pressure refrigerant and a low-pressure refrigerant to provide a sufficient degree of subcooling for the liquid or gas-liquid two-phase refrigerant to be supplied to the load-side expansion device 25 of the indoor unit 2 in which a cooling load is being generated. The flow path of high-pressure or medium-pressure refrigerant of the refrigerant-to-refrigerant heat exchanger 50 is connected between the third expansion device 15 and the second backflow prevention devices 21*a* to 21*d*. One end of the flow path of low-pressure refrigerant is connected between the second backflow prevention devices 21*a* to 21*d*, and the outlet side of the flow path of high-pressure or medium-pressure refrigerant of the refrigerant-to-refrigerant heat exchanger 50, and the other end communicates with the low-pressure pipe at the outlet side of the relay device 3 via the fourth expansion device 27 and the refrigerant-to-refrigerant heat exchanger 50.

The third expansion device 15 functions as a pressure reducing valve or an opening and closing valve. The third expansion device 15 reduces the pressure of liquid refrigerant to a predetermined pressure, or opens or closes the flow path of the liquid refrigerant. The third expansion device 15 is implemented by, for example, a device with a variable opening degree, such as an electronic expansion valve. The third expansion device 15 is provided on the pipe to which the liquid refrigerant exiting the gas-liquid separator 14 flows.

The fourth expansion device 27 functions as a pressure reducing valve or an opening and closing valve. In heating only operation mode, the fourth expansion device 27 opens or closes the flow path of refrigerant, and in heating main operation mode, the fourth expansion device 27 regulates the flow rate of a bypass liquid in accordance with the indoor-side load. In cooling only operation mode, cooling main operation mode, and heating main operation mode, the fourth expansion device 27 causes refrigerant to exit to the refrigerant-to-refrigerant heat exchanger 50, and regulates the degree of subcooling of the refrigerant supplied to the load-side expansion device 25 of the indoor unit 2 in which a cooling load is being generated. The fourth expansion device 27 is implemented by, for example, a device with a variable opening degree, such as an electronic expansion valve. The fourth expansion device 27 is located in the flow path on the inlet side of low-pressure refrigerant of the refrigerant-to-refrigerant heat exchanger 50.

The number (four in this case) of first opening and closing devices 23*a* to 23*d* equal to the number of indoor units 2*a* to 2*d* to be installed are provided, individually for the corresponding indoor units 2*a* to 2*d*. The first opening and closing devices 23*a* to 23*d* are each implemented by, for example, a solenoid valve or other devices. The first opening and closing devices 23*a* to 23*d* open or close the flow path of the high-temperature, high-pressure gas refrigerant supplied to the corresponding indoor units 2*a* to 2*d*. The first opening and closing devices 23*a* to 23*d* are each connected to the gas-side pipe of the gas-liquid separator 14. The first opening and closing devices 23*a* to 23*d* are only required to be able to open and close a flow path, and may be expansion devices capable of full closing.

The number (four in this case) of second opening and closing devices 24*a* to 24*d* equal to the number of indoor units 2*a* to 2*d* to be installed are provided, individually for the corresponding indoor units 2*a* to 2*d*. The second opening and closing devices 24*a* to 24*d* are each implemented by, for example, a solenoid valve or other devices. The second opening and closing devices 24*a* to 24*d* open and close the flow path of the low-pressure, low-temperature gas refrigerant exiting the corresponding indoor units 2*a* to 2*d*. The second opening and closing devices 24*a* to 24*d* are each connected to the low-pressure pipe that communicates with the outlet side of the relay device 3. The second opening and closing devices 24*a* to 24*d* are only required to be able to open and close a flow path, and may be expansion devices capable of full closing.

The number (four in this case) of second backflow prevention devices 21*a* to 21*d* equal to the number of indoor units 2*a* to 2*d* to be installed are provided, individually for the corresponding indoor units 2*a* to 2*d*. The second backflow prevention devices 21*a* to 21*d* route a high-pressure liquid refrigerant into the indoor units 2*a* to 2*d* in which cooling operation is being performed. The second backflow prevention devices 21*a* to 21*d* are each connected to the pipe at the outlet side of the third expansion device 15. This configuration makes it possible, in cooling main operation mode and heating main operation mode, to prevent a medium-temperature, medium-pressure, liquid or gas-liquid two-phase refrigerant yet to attain a sufficient degree of subcooling that has exited the load-side expansion device 25 of the indoor unit 2 that is performing a heating operation, from entering the load-side expansion device 25 of the indoor unit 2 that is performing a cooling operation. Although the second backflow prevention devices 21*a* to 21*d* are depicted as if the second backflow prevention devices 21*a* to 21*d* are check valves in FIG. 5, the second backflow prevention devices 21*a* to 21*d* used may be any devices capable of preventing backflow of refrigerant, and may be opening and closing devices, or expansion devices capable of full closing.

The number (four in this case) of third backflow prevention devices 22*a* to 22*d* equal to the number of indoor units 2*a* to 2*d* to be installed are provided, individually for the corresponding indoor units 2*a* to 2*d*. The third backflow prevention devices 22*a* to 22*d* route a high-pressure liquid refrigerant into the indoor unit 2 that is performing a cooling operation, and are connected to the pipe at the outlet of the third expansion device 15. In cooling main operation mode and heating main operation mode, the third backflow prevention devices 22*a* to 22*d* prevent a medium-temperature, medium-pressure, liquid or gas-liquid two-phase refrigerant yet to attain a sufficient degree of subcooling that has exited the third expansion device 15, from entering the load-side expansion device 25 of the indoor unit 2 that is performing a cooling operation. Although the third backflow prevention devices 22*a* to 22*d* are depicted as if the third backflow prevention devices 22*a* to 22*d* are check valves in FIG. 5, the third backflow prevention devices 22*a* to 22*d* used may be any devices capable of preventing backflow of refrigerant, and may be opening and closing devices, or expansion devices capable of full closing.

In the relay device 3, an inlet-side pressure sensor 33 is provided on the inlet side of the third expansion device 15, and an outlet-side pressure sensor 34 is provided on the outlet side of the third expansion device 15. The inlet-side pressure sensor 33 detects the temperature of high-pressure refrigerant. The outlet-side pressure sensor 34 detects, in cooling main operation mode, the medium pressure of liquid refrigerant at the outlet of the third expansion device 15.

The relay device 3 is further provided with a temperature sensor 51 that detects the temperature of the high-pressure or medium-pressure refrigerant exiting the refrigerant-to-refrigerant heat exchanger 50. The temperature sensor 51 is provided to the pipe at the outlet side of the flow path of high-pressure or medium-pressure refrigerant of the refrigerant-to-refrigerant heat exchanger 50, and may be implemented by a thermistor or other sensors.

In the air-conditioning apparatus 200 illustrated in FIG. 5 as well, the controller 60 executes various operation modes described later by controlling, for example, the driving frequency of the compressor 10, the rotation speed (including ON/OFF) of the blower device, the switching action of the refrigerant flow switching device 11, the opening degree of the flow regulating unit 42, the opening degree of the load-side expansion device 25, and the opening and closing actions of the first opening and closing devices 23*a* to 23*d*, the second opening and closing devices 24*a* to 24*d*, the fourth expansion device 27, and the third expansion device 15, based on information detected by the various sensors mentioned above and instructions from a remote controller. The controller 60 may be provided for each individual unit, or may be provided in the outdoor unit 201 or the relay device 3.

Various operation modes executed by the air-conditioning apparatus 200 will be described. The air-conditioning apparatus 200 is capable of performing, based on an instruction from each indoor unit 2, either a cooling operation or a heating operation in the corresponding indoor unit 2. That is, the air-conditioning apparatus 200 allows all of the indoor units 2 to perform the same operation, and also allows each individual indoor unit 2 to perform a different operation.

Of the operation modes executed by the air-conditioning apparatus 200, the cooling operation mode includes a cooling only operation mode, in which all of the indoor units 2 being driven perform a cooling operation, and a cooling main operation mode, which is a cooling and heating mixed operation mode in which the cooling load is comparatively greater, and the heating operation mode includes a heating only operation mode, in which all of the indoor units 2 being driven perform a heating operation, and a heating main operation mode, which is a cooling and heating mixed operation mode in which the heating load is comparatively greater. These operation modes will be described below.

[Cooling Only Operation Mode]

Figure 6:
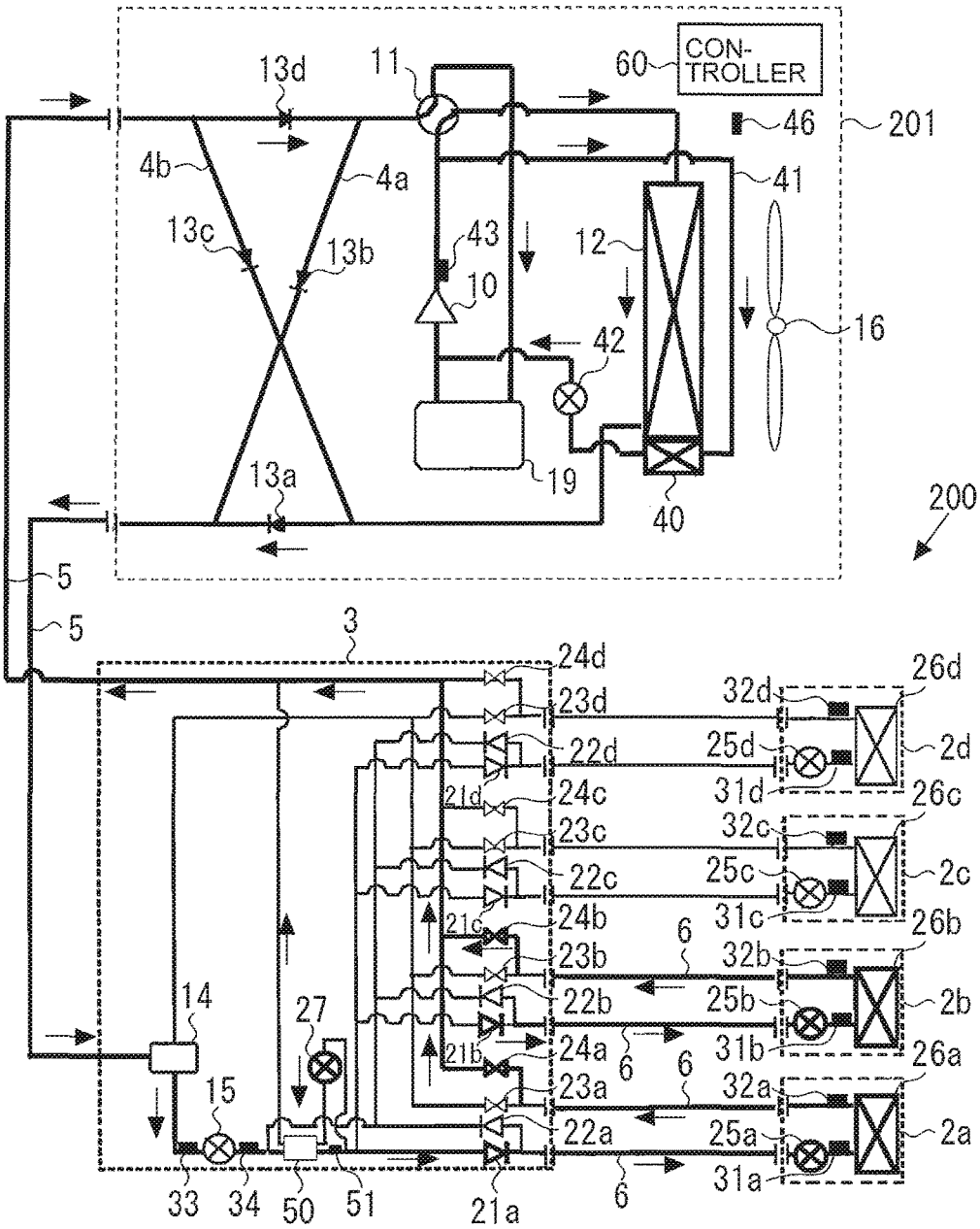
FIG. 6 is a refrigerant circuit diagram illustrating the flow of refrigerant in cooling only operation mode of the air-conditioning apparatus according to Embodiment 2 of the present invention.

FIG. 6 is a refrigerant circuit diagram illustrating the flow of refrigerant in cooling only operation mode of the air-conditioning apparatus 200. In FIG. 6, pipes indicated by thick lines represent pipes through which refrigerant flows, and the direction of flow of refrigerant is indicated by solid arrows. In FIG. 6, the cooling only operation mode will be described with reference to, for example, a case where a cooling load is generated only in the load-side heat exchanger 26*a* and the load-side heat exchanger 26*b*. In cooling only operation mode illustrated in FIG. 6, the controller 60 switches the refrigerant flow switching device 11 of the outdoor unit 201 such that the refrigerant discharged from the compressor 10 is routed into the heat source-side heat exchanger 12.

First, a low-temperature, low-pressure refrigerant is compressed by the compressor 10, and discharged from the compressor 10 as a high-temperature, high-pressure gas refrigerant. The high-temperature, high-pressure gas refrigerant discharged from the compressor 10 enters the heat source-side heat exchanger 12 via the refrigerant flow switching device 11. In the heat source-side heat exchanger 12, the refrigerant changes to a high-pressure liquid refrigerant as the refrigerant rejects heat to the outdoor air. The high-pressure liquid refrigerant exiting the heat source-side heat exchanger 12 passes through the first backflow prevention device 13*a* and exits the outdoor unit 201, and then enters the relay device 3 through the main pipe 5.

After entering the relay device 3, the high-pressure liquid refrigerant passes through the gas-liquid separator 14 and the third expansion device 15 before being sufficiently subcooled in the refrigerant-to-refrigerant heat exchanger 50. Then, most of the subcooled high-pressure refrigerant passes through the second backflow prevention devices 21*a* and 21*b* and the branch pipe 6, and is expanded in the load-side expansion device 25, causing the refrigerant to change to a low-temperature, low-pressure refrigerant that is in a gas-liquid two-phase state. The remaining part of the high-pressure refrigerant undergoes expansion in the fourth expansion device 27, and thus changes to a low-temperature, low-pressure refrigerant that is in a gas-liquid two-phase state. Then, the low-temperature, low-pressure refrigerant in a gas-liquid two-phase state exchanges heat with the high-pressure liquid refrigerant in the refrigerant-to-refrigerant heat exchanger 50, causing the refrigerant to change to a low-temperature, low-pressure gas refrigerant. This refrigerant then enters the low-pressure pipe at the outlet side of the relay device 3. During this process, the opening degree of the fourth expansion device 27 is controlled so as to maintain a constant level of subcooling (degree of subcooling), which is calculated as the difference between a value obtained by converting the pressure detected by the outlet-side pressure sensor 34 into a saturation temperature, and the temperature detected by the temperature sensor 51.

Most of the streams of low-temperature, low-pressure refrigerant in a gas-liquid two-phase state exiting the load-side expansion devices 25*a* and 25*b* respectively enter the load-side heat exchangers 26*a* and 26*b* each serving as an evaporator where the refrigerant removes heat from the indoor air, causing the refrigerant to change to a low-temperature, low-pressure gas refrigerant while cooling the indoor air. During this process, the opening degree of the load-side expansion device 25*a* is controlled so as to maintain a constant level of superheat (degree of superheat), which is calculated as the difference between the temperature detected by the inlet-side temperature sensor 31*a* and the temperature detected by the outlet-side temperature sensor 32*a*. Likewise, the opening degree of the load-side expansion device 25*b* is controlled so as to maintain a constant level of superheat, which is calculated as the difference between the temperature detected by the inlet-side temperature sensor 31*b* and the temperature detected by the outlet-side temperature sensor 32*b*.

The gas refrigerant exiting each of the load-side heat exchangers 26*a* and 26*b* passes through the branch pipe 6 and the second opening and closing device 24, and merges with the gas refrigerant exiting the refrigerant-to-refrigerant heat exchanger 50. The merged refrigerant exits the relay device 3, and passes through the main pipe 5 to enter the outdoor unit 201 again. The refrigerant entering the outdoor unit 201 is routed through the first backflow prevention device 13*d*, and passes through the refrigerant flow switching device 11 and the accumulator 19 before being sucked into the compressor 10 again.

Since no refrigerant needs to be routed through the load-side heat exchanger 26*c* and the load-side heat exchanger 26*d* where no cooling load exists, the corresponding load-side expansion device 25*c* and load-side expansion device 25*d* are in their closed state. When a cooling load is generated in the load-side heat exchanger 26*c* or the load-side heat exchanger 26*d*, the load-side expansion device 25*c* or the load-side expansion device 25*d* opens to allow refrigerant to circulate. During this process, like the load-side expansion device 25*a* or the load-side expansion device 25*b*, the opening degree of the load-side expansion device 25*c* or the load-side expansion device 25*d* is controlled so as to maintain a constant level of superheat (degree of superheat), which is calculated as the difference between the temperature detected by the inlet-side temperature sensor 31 and the temperature detected by the outlet-side temperature sensor 32.

[Cooling Main Operation Mode]

Figure 7:
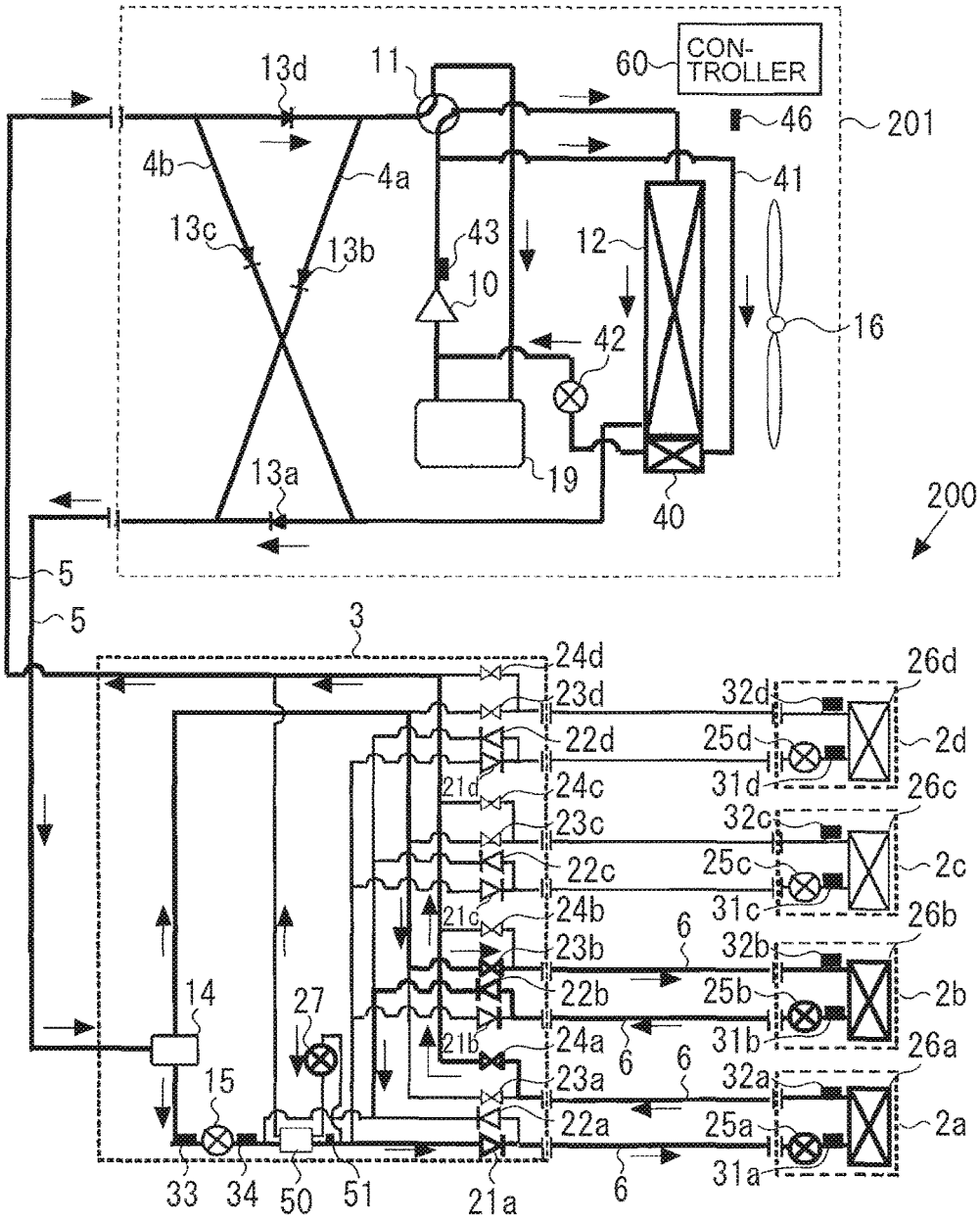
FIG. 7 is a refrigerant circuit diagram illustrating the flow of refrigerant in cooling main operation mode of the air-conditioning apparatus according to Embodiment 2 of the present invention.

FIG. 7 is a refrigerant circuit diagram illustrating the flow of refrigerant in cooling main operation mode of the air-conditioning apparatus 200. In FIG. 7, the cooling main operation mode will be described with reference to, for example, a case where a cooling load is generated in the load-side heat exchanger 26*a* and a heating load is generated in the load-side heat exchanger 26*b*. In FIG. 7, pipes indicated by thick lines represent pipes through which refrigerant circulates, and the direction of flow of refrigerant is indicated by solid arrows. In cooling main operation mode illustrated in FIG. 7, in the outdoor unit 201, the refrigerant flow switching device 11 is switched so as to route the heat source-side refrigerant discharged from the compressor 10 into the heat source-side heat exchanger 12.

First, a low-temperature, low-pressure refrigerant is compressed by the compressor 10, and discharged from the compressor 10 as a high-temperature, high-pressure gas refrigerant. The high-temperature, high-pressure gas refrigerant discharged from the compressor 10 enters the heat source-side heat exchanger 12 via the refrigerant flow switching device 11. In the heat source-side heat exchanger 12, the gas refrigerant changes to a gas-liquid two-phase refrigerant while rejecting heat to the outdoor air. The refrigerant exiting the heat source-side heat exchanger 12 passes through the first backflow prevention device 13*a* and the main pipe 5, and enters the relay device 3.

After entering the relay device 3, the gas-liquid two-phase refrigerant is separated in the gas-liquid separator 14 into a high-pressure gas refrigerant and a high-pressure liquid refrigerant. The high-pressure gas refrigerant passes through the first opening and closing device 23*b* and the branch pipe 6 before entering the load-side heat exchanger 26*b* serving as a condenser, where the high-pressure gas refrigerant rejects heat to the indoor air and thus changes to a liquid refrigerant while heating the indoor space. During this process, the opening degree of the load-side expansion device 25*b* is controlled so as to maintain a constant level of subcooling (degree of subcooling), which is calculated as the difference between a value obtained by converting the pressure detected by the inlet-side pressure sensor 33 into a saturation temperature, and the temperature detected by the inlet-side temperature sensor 31*b*. The liquid refrigerant exiting the load-side heat exchanger 26*b* is expanded in the load-side expansion device 25*b*, and then passes through the branch pipe 6 and the third backflow prevention device 22*b*.

Then, a medium-pressure liquid refrigerant that has been expanded to a medium pressure in the third expansion device 15 after undergoing separation in the gas-liquid separator 14, and the liquid refrigerant that has passed through the third backflow prevention device 22*b* merge. During this process, the opening degree of the third expansion device 15 is controlled so as to provide a predetermined pressure difference (for example, 0.3 MPa) between the pressure detected by the inlet-side pressure sensor 33, and the pressure detected by the outlet-side pressure sensor 34.

After the merged liquid refrigerant is sufficiently subcooled in the refrigerant-to-refrigerant heat exchanger 50, most of the subcooled refrigerant passes through the second backflow prevention device 21*a* and the branch pipe 6, and is then expanded in the load-side expansion device 25*a*, causing the refrigerant to change to a low-temperature, low-pressure refrigerant that is in a gas-liquid two-phase state. The remaining part of the liquid refrigerant undergoes expansion in the fourth expansion device 27, and thus changes to a low-temperature, low-pressure refrigerant that is in a gas-liquid two-phase state. During this process, the opening degree of the fourth expansion device 27 is controlled so as to maintain a constant level of subcooling (degree of subcooling), which is calculated as the difference between a value obtained by converting the pressure detected by the outlet-side pressure sensor 34 into a saturation temperature, and the temperature detected by the temperature sensor 51. Then, the low-temperature, low-pressure refrigerant in a gas-liquid two-phase state exchanges heat with the medium-pressure liquid refrigerant in the refrigerant-to-refrigerant heat exchanger 50, causing the refrigerant to change to a low-temperature, low-pressure gas refrigerant. This refrigerant then enters the low-pressure pipe at the outlet side of the relay device 3.

The high-pressure liquid refrigerant separated in the gas-liquid separator 14 passes through the refrigerant-to-refrigerant heat exchanger 50 and the second backflow prevention device 21*a* before entering the indoor unit 2*a*. Most of the refrigerant in a gas-liquid two-phase state expanded in the load-side expansion device 25*a* of the indoor unit 2*a* enters the load-side heat exchanger 26*a* serving as an evaporator where the refrigerant removes heat from the indoor air, causing the refrigerant to change to a low-temperature, low-pressure gas refrigerant while cooling the indoor air. During this process, the opening degree of the load-side expansion device 25*a* is controlled so as to maintain a constant level of superheat (degree of superheat), which is calculated as the difference between the temperature detected by the inlet-side temperature sensor 31*a* and the temperature detected by the outlet-side temperature sensor 32*b*. The gas refrigerant exiting the load-side heat exchanger 26*a* passes through the branch pipe 6 and the second opening and closing device 24*a* before merging with the remaining part of the gas refrigerant that has exited the refrigerant-to-refrigerant heat exchanger 50. The merged refrigerant then exits the relay device 3, and passes through the main pipe 5 to enter the outdoor unit 201 again. The refrigerant entering the outdoor unit 201 is routed through the first backflow prevention device 13*d*, and passes through the refrigerant flow switching device 11 and the accumulator 19 before being sucked into the compressor 10 again.

Since no refrigerant needs to be routed through the load-side heat exchanger 26*c* and the load-side heat exchanger 26*d* where no thermal load exists, the corresponding load-side expansion device 25*c* and load-side expansion device 25*d* are in their closed state. When a cooling load is generated in the load-side heat exchanger 26*c* or the load-side heat exchanger 26*d*, the load-side expansion device 25*c* or the load-side expansion device 25*d* opens to allow refrigerant to circulate. During this process, like the load-side expansion device 25*a* or the load-side expansion device 25*b*, the opening degree of the load-side expansion device 25*c* or the load-side expansion device 25*d* is controlled so as to maintain a constant level of superheat (degree of superheat), which is calculated as the difference between the temperature detected by the inlet-side temperature sensor 31 and the temperature detected by the outlet-side temperature sensor 32.

[Heating Only Operation Mode]

Figure 8:
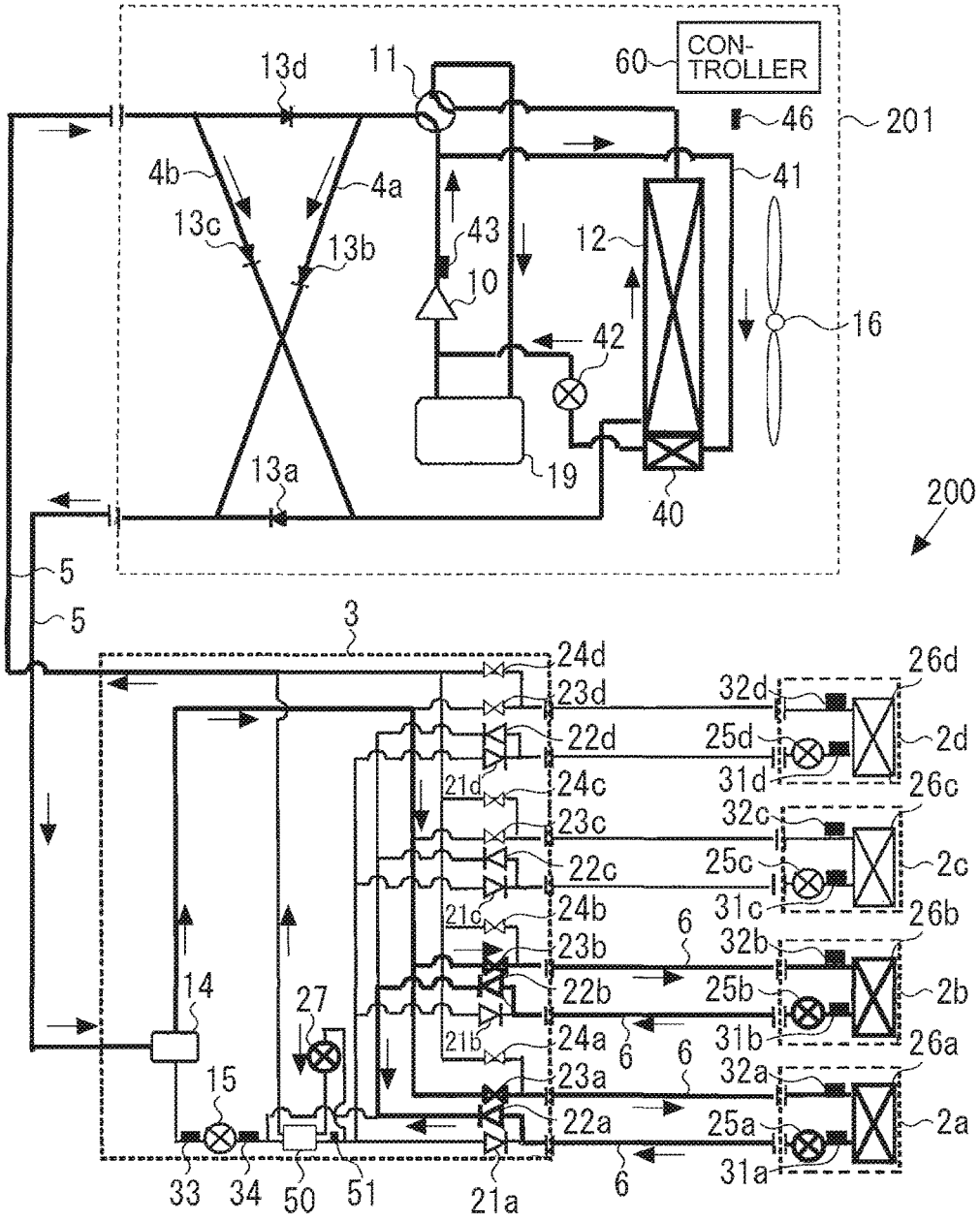
FIG. 8 is a refrigerant circuit diagram illustrating the flow of refrigerant in heating only operation mode of the air-conditioning apparatus according to Embodiment 2 of the present invention.

FIG. 8 is a refrigerant circuit diagram illustrating the flow of refrigerant in heating only operation mode of the air-conditioning apparatus 200. In FIG. 8, pipes indicated by thick lines represent pipes through which refrigerant flows, and the direction of flow of refrigerant is indicated by solid arrows. In FIG. 8, the heating only operation mode will be described with reference to, for example, a case where a cooling load is generated only in the load-side heat exchanger 26*a* and the load-side heat exchanger 26*b*. In heating only operation mode illustrated in FIG. 8, in the outdoor unit 201, the refrigerant flow switching device 11 is switched such that the heat source-side refrigerant discharged from the compressor 10 is routed into the relay device 3 without passing through the heat source-side heat exchanger 12.

First, a low-temperature, low-pressure refrigerant is compressed by the compressor 10, and discharged from the compressor 10 as a high-temperature, high-pressure gas refrigerant. The high-temperature, high-pressure gas refrigerant discharged from the compressor 10 passes through the refrigerant flow switching device 11 and the first backflow prevention device 13*b*, before exiting the outdoor unit 201. The high-temperature, high-pressure gas refrigerant exiting the outdoor unit 201 enters the relay device 3 through the main pipe 5.

After entering the relay device 3, the high-temperature, high-pressure gas refrigerant passes through the gas-liquid separator 14, the first opening and closing devices 23*a* and 23*b*, and the branch pipe 6, before entering each of the load-side heat exchanger 26*a* and the load-side heat exchanger 26*b* that act as a condenser. The refrigerant entering each of the load-side heat exchanger 26*a* and the load-side heat exchanger 26*b* rejects heat to the indoor air, and thus changes to a liquid refrigerant while heating the indoor space. The exit streams of refrigerant from the load-side heat exchanger 26*a* and the load-side heat exchanger 26*b* are respectively expanded in the load-side expansion devices 25*a* and 25*b*, and pass through the branch pipe 6, the third backflow prevention devices 22*a* and 22*b*, the refrigerant-to-refrigerant heat exchanger 50, the fourth expansion device 27 being controlled to be in its open state, and the main pipe 5, before entering the outdoor unit 201 again. During this process, the opening degree of the load-side expansion device 25*a* is controlled so as to maintain a constant level of subcooling (degree of subcooling), which is calculated as the difference between a value obtained by converting the pressure detected by the inlet-side pressure sensor 33 into a saturation temperature, and the temperature detected by the inlet-side temperature sensor 31*a*. Likewise, the opening degree of the load-side expansion device 25*b* is controlled so as to maintain a constant level of subcooling (degree of subcooling), which is calculated as the difference between a value obtained by converting the pressure detected by the inlet-side pressure sensor 33 into a saturation temperature, and the temperature detected by the inlet-side temperature sensor 31*b*.

The refrigerant entering the outdoor unit 201 passes through the first backflow prevention device 13*c*, and in the heat source-side heat exchanger 12, the refrigerant changes to a low-temperature, low-pressure gas refrigerant while removing heat from the outdoor air. The low-temperature, low-pressure gas refrigerant then passes through the refrigerant flow switching device 11 and the accumulator 19 before being sucked into the compressor 10 again.

Since no refrigerant needs to be routed through the load-side heat exchanger 26*c* and the load-side heat exchanger 26*d* where no thermal load exists, the corresponding load-side expansion device 25*c* and load-side expansion device 25*d* are in their closed state. When a cooling load is generated in the load-side heat exchanger 26*c* or the load-side heat exchanger 26*d*, the load-side expansion device 25*c* or the load-side expansion device 25*d* opens to allow refrigerant to circulate. During this process, like the load-side expansion device 25*a* or the load-side expansion device 25*b*, the opening degree of the load-side expansion device 25*c* or the load-side expansion device 25*d* is controlled so as to maintain a constant level of superheat (degree of superheat), which is calculated as the difference between the temperature detected by the inlet-side temperature sensor 31 and the temperature detected by the outlet-side temperature sensor 32.

[Heating Main Operation Mode]

Figure 9:
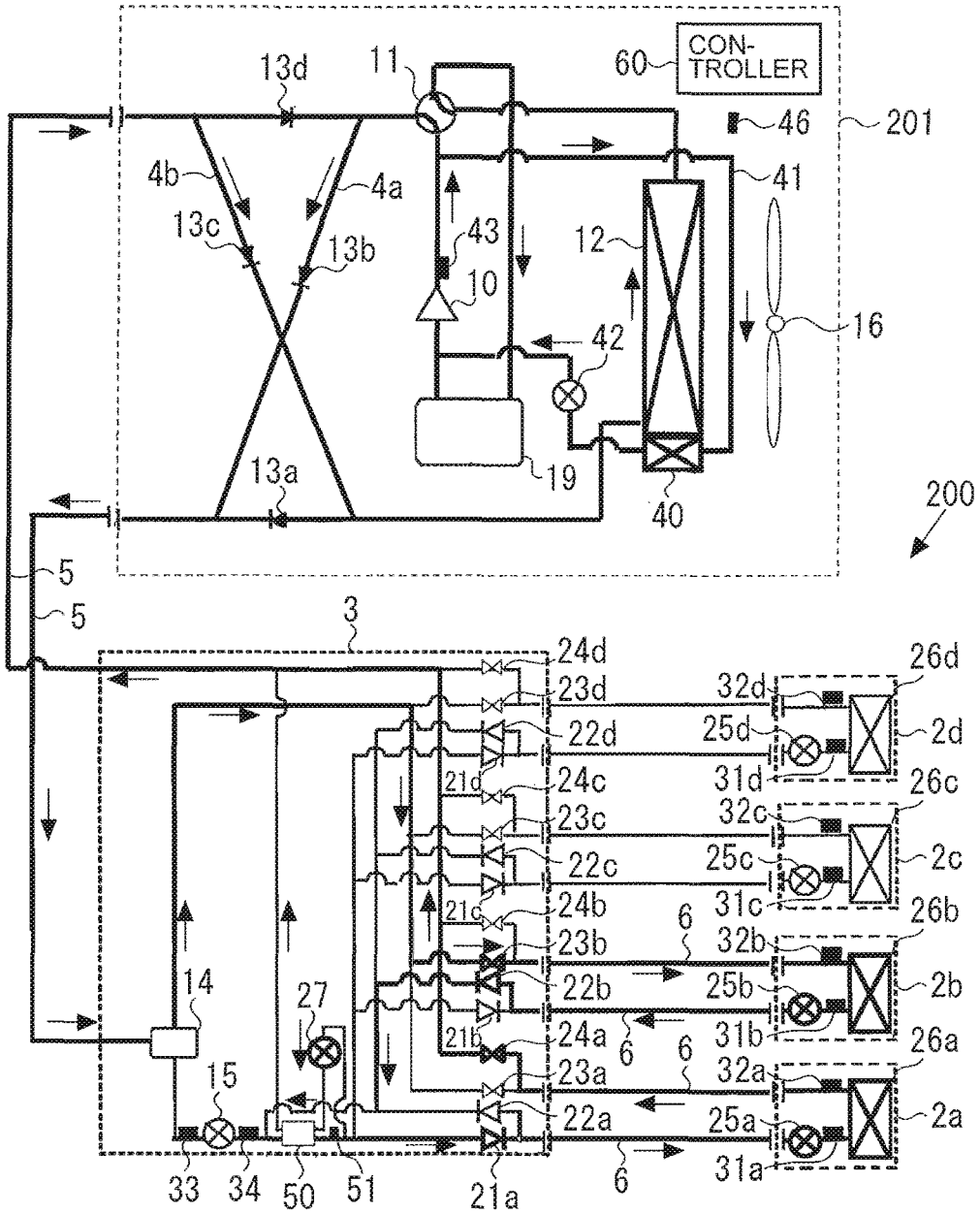
FIG. 9 is a refrigerant circuit diagram illustrating the flow of refrigerant in heating main operation mode of the air-conditioning apparatus according to Embodiment 2 of the present invention.

FIG. 9 is a refrigerant circuit diagram illustrating the flow of refrigerant in heating main operation mode of the air-conditioning apparatus 200. In FIG. 9, pipes indicated by thick lines represent pipes through which refrigerant circulates, and the direction of flow of refrigerant is indicated by solid arrows. In FIG. 9, the heating main operation mode will be described with reference to, for example, a case where a cooling load is generated in the load-side heat exchanger 26*a*, and a heating load is generated in the load-side heat exchanger 26*b*. In heating main operation mode illustrated in FIG. 9, in the outdoor unit 201, the refrigerant flow switching device 11 is switched such that the heat source-side refrigerant discharged from the compressor 10 is routed into the relay device 3 without passing through the heat source-side heat exchanger 12.

A low-temperature, low-pressure refrigerant is compressed by the compressor 10, and discharged from the compressor 10 as a high-temperature, high-pressure gas refrigerant. The high-temperature, high-pressure gas refrigerant discharged from the compressor 10 passes through the refrigerant flow switching device 11 and the first backflow prevention device 13*b*, before exiting the outdoor unit 201. The high-temperature, high-pressure gas refrigerant exiting the outdoor unit 201 enters the relay device 3 through the main pipe 5.

The high-temperature, high-pressure gas refrigerant entering the relay device 3 passes through the gas-liquid separator 14, the third expansion device 15, the first opening and closing device 23*b*, and the branch pipe 6, before entering the load-side heat exchanger 26*b* serving as a condenser. The refrigerant entering the load-side heat exchanger 26*b* rejects heat to the indoor air, and thus changes to a liquid refrigerant while heating the indoor space. The liquid refrigerant exiting the load-side heat exchanger 26*b* is expanded in the load-side expansion device 25*b*, and the resulting refrigerant passes through the branch pipe 6 and the third backflow prevention device 22*b* before being sufficiently subcooled in the refrigerant-to-refrigerant heat exchanger 50. Then, most of the subcooled refrigerant passes through the second backflow prevention device 21*a* and the branch pipe 6, and is expanded in the load-side expansion device 25*a*, causing the refrigerant to change to a low-temperature, low-pressure refrigerant that is in a gas-liquid two-phase state. The remaining part of the liquid refrigerant is expanded in the fourth expansion device 27, which also serves as a bypass, causing the liquid refrigerant to change to a low-temperature, low-pressure refrigerant that is in a gas-liquid two-phase state. This refrigerant then exchanges heat with the liquid refrigerant in the refrigerant-to-refrigerant heat exchanger 50, resulting in a low-temperature, low-pressure refrigerant that is in a gaseous or gas-liquid two-phase state. This refrigerant then enters the low-pressure pipe at the outlet side of the relay device 3.

Most of the refrigerant expanded in the load-side expansion device 25*a* enters the load-side heat exchanger 26*a* serving as an evaporator where the refrigerant removes heat from the indoor air, causing the refrigerant to change to a low-temperature, medium-pressure refrigerant that is in a gas-liquid two-phase state. The refrigerant in a gas-liquid two-phase state exiting the load-side heat exchanger 26*a* passes through the branch pipe 6 and the second opening and closing device 24*a*, before merging with the remaining part of the gas refrigerant that has exited the refrigerant-to-refrigerant heat exchanger 50. The merged refrigerant then exits the relay device 3, and passes through the main pipe 5 to enter the outdoor unit 201 again. The refrigerant entering the outdoor unit 201 passes through the first backflow prevention device 13*c*, and changes to a low-temperature, low-pressure refrigerant that is in a gas-liquid two-phase state. This refrigerant then changes to a low-temperature, low-pressure gas refrigerant in the heat source-side heat exchanger 12 while removing heat from the outdoor air. The low-temperature, low-pressure gas refrigerant then passes through the refrigerant flow switching device 11 and the accumulator 19 before being sucked into the compressor 10 again.

During this process, the opening degree of the load-side expansion device 25*b* is controlled so as to maintain a constant level of subcooling (degree of subcooling), which is calculated as the difference between a value obtained by converting the pressure detected by the inlet-side pressure sensor 33 into a saturation temperature, and the temperature detected by the inlet-side temperature sensor 31*b*. The opening degree of the load-side expansion device 25*a* is controlled so as to maintain a constant level of superheat (degree of superheat), which is calculated as the difference between the temperature detected by the inlet-side temperature sensor 31*a* and the temperature detected by the outlet-side temperature sensor 32*b*.

The opening degree of the fourth expansion device 27 is controlled so as to maintain a constant level of subcooling (degree of subcooling), which is calculated as the difference between a value obtained by converting the pressure detected by the outlet-side pressure sensor 34 into a saturation temperature, and the temperature detected by the temperature sensor 51. For example, the opening degree of the fourth expansion device 27 is controlled so as to provide a predetermined pressure difference (for example, 0.3 MPa) between the pressure detected by the inlet-side pressure sensor 33, and the pressure detected by the outlet-side pressure sensor 34.

Since no refrigerant needs to be routed through the load-side heat exchanger 26*c* and the load-side heat exchanger 26*d* where no thermal load exists, the corresponding load-side expansion device 25*c* and load-side expansion device 25*d* are in their closed state. When a thermal load is generated in the load-side heat exchanger 26*c* or the load-side heat exchanger 26*d*, the load-side expansion device 25*c* or the load-side expansion device 25*d* may be opened to allow refrigerant to circulate.

As in the air-conditioning apparatus 100 illustrated in FIGS. 1 to 4, in the air-conditioning apparatus 200 illustrated in FIGS. 5 to 9, in cooling operation mode and heating operation mode, the high-pressure gas refrigerant discharged from the compressor 10 is subcooled, and the resulting refrigerant is routed into the suction part of the compressor 10 via the flow regulating unit 42. This ensures the reliability of the system even when an inexpensive compressor is used rather than a compressor having a special structure. Further, limiting an excessive rise in the discharge temperature of the compressor 10 allows for an increase in the rotation speed of the compressor 10 to ensure sufficient heating capacity, thus minimizing a decrease in user comfort.

In the air-conditioning apparatus 200, the calculation method for and the size of the required total heat transfer area A1 ($m^2$), which represents the area of contact of the auxiliary heat exchanger 40 with the air of the environment under which the outdoor unit 201 is installed, are the same as those in Embodiment 1.

In the air-conditioning apparatus 200, a first flow path opening and closing device, such as an opening and closing device, or an expansion device capable of full closing that can open and close a flow path, may be provided at the inlet side of the auxiliary heat exchanger 40. In situations such as when there is no need to limit an excessive rise in the discharge temperature of the compressor 10, the controller 60 may control the first flow path opening and closing device and the opening and closing device 47 to be closed, and control the flow regulating unit 42 to a small opening degree just short of full closure. This configuration can minimize stagnation of refrigeration in the bypass pipe 41 and the auxiliary heat exchanger 40. Accordingly, when a necessity arises to limit an excessive rise in the discharge temperature of the compressor 10, the above configuration prevents an excessive amount of liquid refrigerant from flowing into the suction part of the compressor 10 from the flow regulating unit 42, thus preventing damage to the compressor 10 due to excessive liquid return to the compressor 10.

Embodiment 3

Figure 10:
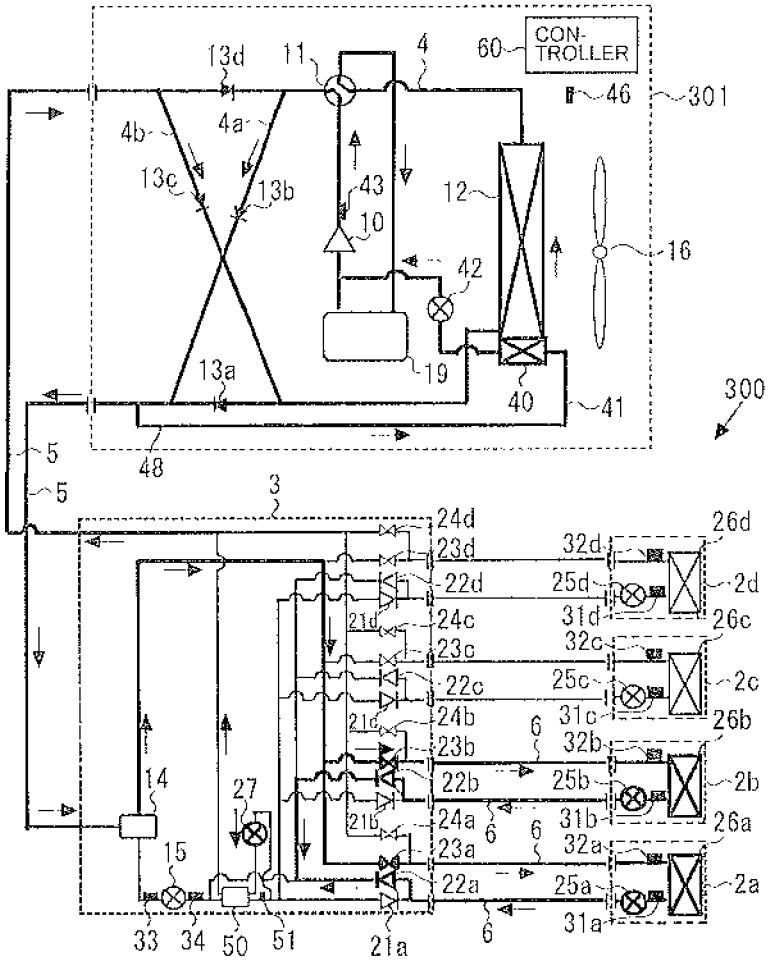
FIG. 10 is a refrigerant circuit diagram illustrating the flow of refrigerant in heating only operation mode of an air-conditioning apparatus according to Embodiment 3 of the present invention.

FIG. 10 is a refrigerant circuit diagram illustrating the flow of refrigerant in heating only operation mode of an air-conditioning apparatus according to Embodiment 3. The following description of Embodiment 3 will mainly focus on differences from Embodiment 2, and parts that are the same as those in Embodiment 2 will be denoted by the same reference signs. An air-conditioning apparatus 300 illustrated in FIG. 10 differs from the air-conditioning apparatus 200 illustrated in FIGS. 5 to 9 in the configuration of an outdoor unit 301.

In the outdoor unit 301 of the air-conditioning apparatus 300, one end of the bypass pipe 41 is connected to the part of the refrigerant pipe 4 between the first backflow prevention device 13*a* and the main pipe 5.

When a rise in the temperature of refrigerant discharged from the compressor 10 is to be limited in cooling only operation mode and cooling main operation mode, a part of the high-pressure liquid refrigerant exiting the heat source-side heat exchanger 12 is routed into the auxiliary heat exchanger 40 via the bypass pipe 41. In this way, after the refrigerant changes to a high-pressure subcooled liquid in the auxiliary heat exchanger 40 while rejecting heat to the outdoor air supplied from the fan 16, the resulting refrigerant is routed into the suction part of the compressor 10 via the flow regulating unit 42, thus allowing the temperature of refrigerant discharged from the compressor 10 to be reduced.

When a rise in the temperature of refrigerant discharged from the compressor 10 is to be limited in heating only operation mode and heating main operation mode, a part of the high-pressure gas refrigerant discharged from the compressor 10 and exiting the first backflow prevention device 13*b* is routed into the auxiliary heat exchanger 40 via the bypass pipe 41.

The air-conditioning apparatus 300 makes it possible to reduce the required total heat transfer area A1 ($m^2$), which represents the area of contact of the auxiliary heat exchanger 40 with the air of the environment under which the outdoor unit 1 is installed. That is, in cooling only operation mode and cooling main operation mode, the high-pressure, low-temperature refrigerant discharged from the compressor 10 and cooled in the heat source-side heat exchanger 12 is subcooled in the auxiliary heat exchanger 40. Thus, only a small amount of heat needs to be exchanged in the auxiliary heat exchanger 40, and hence the auxiliary heat exchanger 40 needs to have only a small heat transfer area. Although the method for calculating the heat transfer area of the auxiliary heat exchanger 40 is the same as that in Embodiment 1, the change in the temperature of refrigerant in the auxiliary heat exchanger 40 needs to be taken into account.

Specifically, letting ΔTm (K or degrees C.) be the logarithmic mean temperature difference, Tr1 (K or degrees C.) be the temperature of refrigerant entering the heat transfer tubes in the auxiliary heat exchanger 40, Tr2 (K or degrees C.) be the temperature of refrigerant exiting the heat transfer tubes, T1 be the temperature of air entering the auxiliary heat exchanger 40, and T2 (K or degrees C.) be the temperature of air exiting the auxiliary heat exchanger 40, the calculation can be performed by rewriting Equation (4) as Equation (5).

[Eq. 5]

$$\Delta Tm = \frac{(Tr1 - T2) - (Tr2 - T1)}{\ln\left(\frac{Tr1 - T2}{Tr2 - T1}\right)} \tag{5}$$

For example, suppose that the saturation temperature of refrigerant cooled in the heat source-side heat exchanger 12 is 54 degrees C., and the refrigerant is cooled down to a saturated liquid at 54 degrees C. in the heat source-side heat exchanger 12. Then, the enthalpy $h_3$ of the saturated liquid at 54 degrees C. is approximately 307 (kJ/kg). Suppose that, for the saturated liquid at 54 degrees C. to be sufficiently subcooled by exchanging heat with air at approximately 43 degrees C. in the auxiliary heat exchanger 40, approximately 5 degrees C. is to be provided as a degree of subcooling representing the difference in temperature between the saturated liquid at 54 degrees C. and the liquid refrigerant at the outlet side of the auxiliary heat exchanger 40. In this case, the enthalpy $h_2$ at the outlet of the auxiliary heat exchanger 40 is determined by the pressure calculated from the refrigerant's saturation temperature of 54 degrees C., and the temperature of the liquid refrigerant at the outlet of the auxiliary heat exchanger 40. In the present case, the enthalpy $h_2$ is determined to be approximately 296 (kJ/kg). Assuming that the temperature of saturated gas at the suction part of the compressor 10 is approximately zero degrees C., the enthalpy $h_1$ of refrigerant entering the suction part of the compressor 10 from the accumulator 19 is determined to be approximately 515 (kJ/kg).

Therefore, assuming that the adiabatic efficiency of the compressor 10 is 0.6, and refrigerant is to be compressed to a pressure corresponding to 54 degrees C. that is the saturation temperature of refrigerant within the heat source-side heat exchanger 12, the refrigerant flow rate $Gr_2$ required to make the discharge temperature of the compressor 10 equal to or less than the discharge temperature threshold (115 degrees C. or lower) is determined from Equation (1) to be approximately 12 (kg/h), and the amount of heat exchange Q1 required for the auxiliary heat exchanger 40 is determined from Equation (2) to be approximately 40 (W).

Then, suppose that the temperature Tr1 of refrigerant entering the heat transfer tubes in the auxiliary heat exchanger 40 is approximately 54 (degrees C.), the temperature Tr2 of refrigerant exiting the heat transfer tubes is 49 (degrees C.), and the temperature T1 of air entering the auxiliary heat exchanger 40 is 43 (degrees C.). As for the temperature T2 of air exiting the auxiliary heat exchanger 40, owing to the small amount of heat exchange Q1 in the auxiliary heat exchanger 40 of approximately 40 (W), the temperature of air is supposed to remain substantially unchanged, and thus the temperature T2 is given to be 44 (degrees C.), assuming a temperature rise of approximately one degree C. from the temperature of incoming air. In this case, the logarithmic mean temperature difference is determined from Equation (4) to be approximately 7.83 (degrees C.), and assuming that the overall heat transmission coefficient k based on the tube's outer side is approximately 25 ($W/(m^2 \cdot K)$), which is a value for a liquid cooler obtained by the results of a large number of tests for cooling operation mode, the total heat transfer area A1 required for the auxiliary heat exchanger 40 is determined from Equation (3) to be approximately 0.204 ($m^2$).

When an R32 refrigerant is used for the air-conditioning apparatus 100 equivalent to 10 horsepower, the total heat transfer area A2 required for the heat source-side heat exchanger 12 is approximately 141 ($m^2$). With the auxiliary heat exchanger 40 regarded as a part of the heat source-side heat exchanger 12, the ratio A1/(A1+A2), which is the ratio of the total heat transfer area A1 of the auxiliary heat exchanger 40 to the sum of the total heat transfer area A2 required for the heat source-side heat exchanger 12 and the total heat transfer area A1 required for the auxiliary heat exchanger 40, is determined to be equal to or greater than approximately 0.144% (=0.204/141.644).

As in the air-conditioning apparatus 200 illustrated in FIGS. 5 to 9, in the air-conditioning apparatus 300 illustrated in FIG. 10, refrigerant is routed into the suction part of the compressor 10 via the auxiliary heat exchanger 40 and the flow regulating unit 42 in cooling operation mode and in heating operation mode. This ensures the reliability of the system even when an inexpensive compressor is used rather than a compressor having a special structure. Further, limiting an excessive rise in the discharge temperature of the compressor 10 allows for an increase in the rotation speed of the compressor 10 to ensure sufficient heating capacity, thus minimizing a decrease in user comfort.

In the air-conditioning apparatus 300 illustrated in FIG. 10, to limit a rise in the temperature of refrigerant discharged from the compressor 10 in cooling only operation mode and cooling main operation mode, a part of the high-pressure liquid refrigerant exiting the heat source-side heat exchanger 12 is routed into the auxiliary heat exchanger 40 via the bypass pipe 41. This allows the required size of the auxiliary heat exchanger 40 to be reduced. Thus, the heat transfer area of the heat source-side heat exchanger can be increased, allowing for improved performance.

In the air-conditioning apparatus 300, a first flow path opening and closing device, such as an opening and closing device, or an expansion device capable of full closing that can open and close a flow path, may be provided at the inlet side of the auxiliary heat exchanger 40. In situations such as when there is no need to limit an excessive rise in the discharge temperature of the compressor 10, the controller 60 may control the first flow path opening and closing device and the opening and closing device 47 to be closed, and control the flow regulating unit 42 to a small opening degree just short of full closure. This configuration can minimize stagnation of refrigeration in the bypass pipe 41 and the auxiliary heat exchanger 40. When a necessity arises to limit an excessive rise in the discharge temperature of the compressor 10, the above configuration prevents an excessive amount of liquid refrigerant from flowing into the suction part of the compressor 10 from the flow regulating unit 42, thus preventing damage to the compressor 10 due to excessive liquid return to the compressor 10.

Embodiment 4

Figure 11:
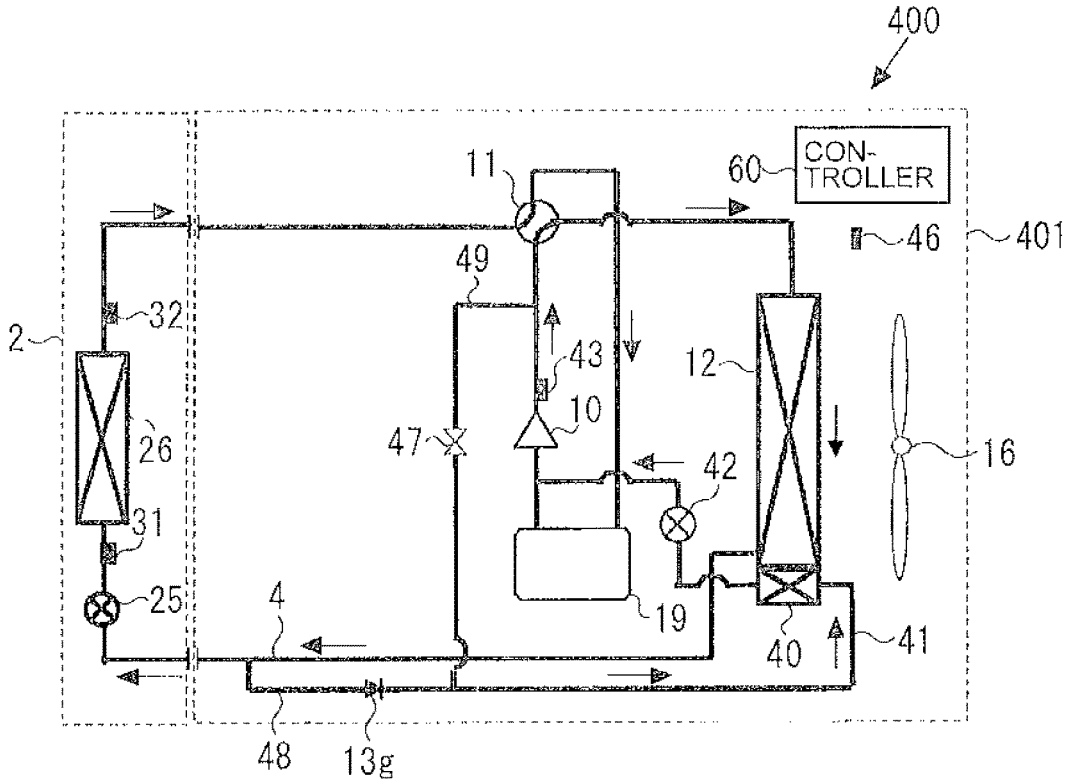
FIG. 11 is a refrigerant circuit diagram illustrating the flow of refrigerant in cooling only operation mode of an air-conditioning apparatus according to Embodiment 4 of the present invention.

FIG. 11 is a refrigerant circuit diagram illustrating the flow of refrigerant in cooling only operation mode of an air-conditioning apparatus according to Embodiment 4. The following description of Embodiment 4 will mainly focus on differences from Embodiment 1, and portions that are the same as those in Embodiment 1 will be denoted by the same reference signs. An air-conditioning apparatus 400 illustrated in FIG. 11 differs from the air-conditioning apparatus 100 in the configuration of an outdoor unit 401.

That is, in the outdoor unit 401 of the air-conditioning apparatus 400, one end of the bypass pipe 41 is diverged in two directions into a first branching pipe 48 and a second branching pipe 49. One end of the first branching pipe 48 is connected to the part of the refrigerant pipe 4 between the heat source-side heat exchanger 12 and the load-side expansion device 25, and the other end of the first branching pipe 48 merges with the second branching pipe 49 via the backflow prevention device 13*g* and is connected to the bypass pipe 41. One end of the second branching pipe 49 is connected to the part of the refrigerant pipe 4 between the flow path on the discharge side of the compressor 10 and the refrigerant flow switching device 11. The other end of the second branching pipe 49 merges with the first branching pipe 48 via the opening and closing device 47, and is connected to the bypass pipe 41. The opening and closing device 47 is only required to be able to open and close a passage, and may be an expansion device capable of full closing.

The backflow prevention device 13*g* is provided so that, when a high-pressure gas refrigerant is to be routed into the auxiliary heat exchanger 40 in heating operation mode, the backflow prevention device 13*g* prevents the high-pressure gas refrigerant discharged from the compressor 10 from flowing backward to the refrigerant pipe 4, which is a flow path of high-pressure, liquid or gas-liquid two-phase refrigerant exiting the load-side heat exchanger 26.

In the air-conditioning apparatus 400, to limit a rise in the temperature of refrigerant discharged from the compressor 10 in heating operation mode, a part of the high-pressure gas refrigerant discharged from the compressor 10 is routed into the auxiliary heat exchanger 40 via the second branching pipe 49, the opening and closing device 47 that is being controlled to open, and the bypass pipe 41. Then, the refrigerant changes to a high-pressure subcooled liquid in the auxiliary heat exchanger 40 while rejecting heat to the outdoor air supplied from the fan 16, and the high-pressure subcooled liquid refrigerant enters the suction part of the compressor 10 via the flow regulating unit 42. As a result, the temperature of refrigerant discharged from the compressor 10 can be lowered.

In cooling operation mode, the opening and closing device 47 is controlled to be closed, and when a rise in the temperature of refrigerant discharged from the compressor 10 is to be limited, a part of the high-pressure liquid refrigerant exiting the heat source-side heat exchanger 12 is routed into the auxiliary heat exchanger 40 via the first branching pipe 48 and the bypass pipe 41. Then, the refrigerant changes to a high-pressure subcooled liquid in the auxiliary heat exchanger 40 while rejecting heat to the outdoor air supplied from the fan 16, and the high-pressure subcooled liquid refrigerant enters the suction part of the compressor 10 via the flow regulating unit 42. As a result, the temperature of refrigerant discharged from the compressor 10 can be lowered. Although the backflow prevention device 13*g* is depicted as if the backflow prevention device 13*g* is a check valve, the backflow prevention device 13*g* may be any device capable of preventing backflow of refrigerant, and may be an opening and closing device, or an expansion device capable of full closing. Further, the opening and closing device 47 is only required to be able to open and close a flow path, and may be an expansion device capable of full closing.

Although the air-conditioning apparatus 400 is provided with the backflow prevention device 13*g*, a first diverging-pipe opening and closing device, such as an opening and closing device, or an expansion device capable of full closing that can open and close a flow path, may be provided instead of the backflow prevention device 13*g*. In situations such as when there is no need to limit an excessive rise in the discharge temperature of the compressor 10, the first diverging-pipe opening and closing device and the opening and closing device 47 may be controlled to be closed, and the flow regulating unit 42 may be controlled to a small opening degree short of full closure. This configuration can minimize stagnation of refrigeration in the bypass pipe 41 and the auxiliary heat exchanger 40. When a necessity arises to limit an excessive rise in the discharge temperature of the compressor 10, the above configuration prevents an excessive amount of liquid refrigerant from flowing into the suction part of the compressor 10 from the flow regulating unit 42, thus preventing damage to the compressor 10 due to excessive liquid return to the compressor 10.

As described above, in the air-conditioning apparatus 400 illustrated in FIG. 11 as well, refrigerant is routed into the suction part of the compressor 10. This ensures the reliability of the system even when an inexpensive compressor is used rather than a compressor having a special structure. Further, limiting an excessive rise in the discharge temperature of the compressor 10 allows for an increase in the rotation speed of the compressor 10 to ensure sufficient heating capacity, thus minimizing a decrease in user comfort.

In the air-conditioning apparatus 400 illustrated in FIG. 11, to limit a rise in the temperature of refrigerant discharged from the compressor 10 in cooling operation mode, a part of the high-pressure liquid refrigerant exiting the heat source-side heat exchanger 12 is routed into the auxiliary heat exchanger 40 via the bypass pipe 41. This allows for a reduction in the required size of the auxiliary heat exchanger 40. Thus, the heat transfer area of the heat source-side heat exchanger can be increased, allowing for improved performance.

In the air-conditioning apparatus 400, the calculation method for and the size of the required total heat transfer area A1 ($m^2$), which represents the area of contact of the auxiliary heat exchanger 40 with the air of the environment under which the outdoor unit 201 of the auxiliary heat exchanger 40 is installed, are the same as those in Embodiment 1.

Embodiment 5

Figure 12:
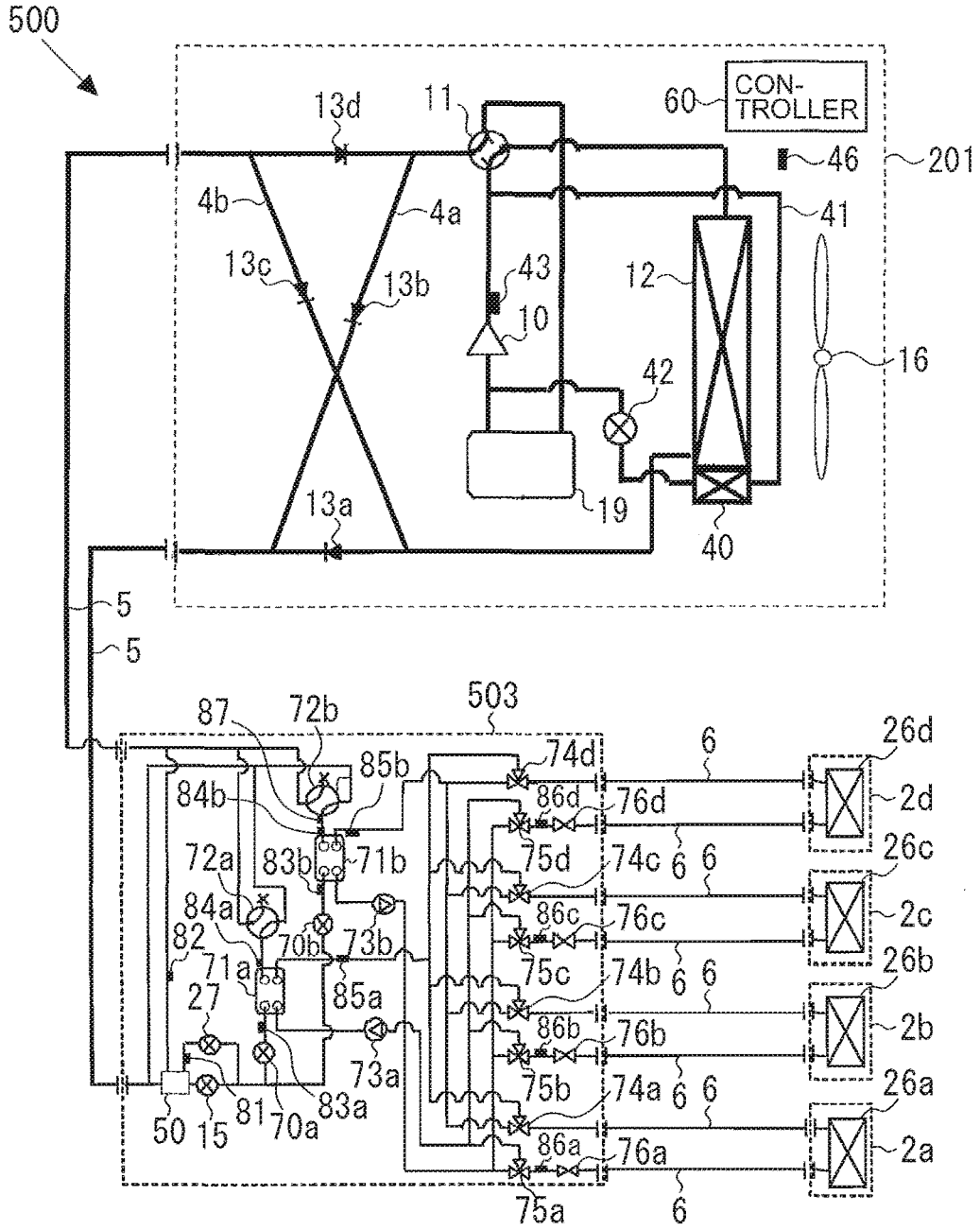
FIG. 12 is a refrigerant circuit diagram illustrating the flow of refrigerant in cooling only operation mode of an air-conditioning apparatus according to another embodiment of the present invention.

FIG. 12 is a refrigerant circuit diagram illustrating an exemplary circuit configuration of an air-conditioning apparatus according to Embodiment 5 of the present invention. The following description of Embodiment 5 will mainly focus on differences from Embodiment 2 mentioned above, and portions that are the same as those in Embodiment 2 will be denoted by the same reference signs. An air-conditioning apparatus 500 illustrated in FIG. 12 differs from the air-conditioning apparatus 200 in the configuration of a relay device 503.

That is, in the air-conditioning apparatus 500, a primary-side cycle, through which a first refrigerant (to be referred to as refrigerant hereinafter) is circulated, is formed between an outdoor unit 501 and the relay device 503, and a secondary-side cycle, through which a second refrigerant (to be referred to as brine hereinafter) is circulated, is formed between the relay device 503 and the indoor units 2*a* to 2*d*, with heat exchange between the primary-side cycle and the secondary-side cycle taking place in a first intermediate heat exchanger 71*a* and a second intermediate heat exchanger 71*b* that are installed in the relay device 503. Examples of brine that may be used include water, antifreeze, and water with added corrosion preventive.

[Indoor Units 2*a* to 2*d*]

The indoor units 2*a* to 2*d* have, for example, the same configuration, and respectively include the load-side heat exchangers 26*a* to 26*d*. The load-side heat exchangers 26*a* to 26*d* are each connected to the relay device 503 via the branch pipe 6. The load-side heat exchangers 26*a* to 26*d* allow heat to be exchanged between air supplied from a blower device such as a fan (not illustrated), and refrigerant to thereby generate the heating air or cooling air to be supplied to the indoor space.

[Relay Device 503]

The relay device 503 has the refrigerant-to-refrigerant heat exchanger 50, the third expansion device 15, the fourth expansion device 27, a first flow control device 70*a*, a second flow control device 70*b*, the first intermediate heat exchanger 71*a*, the second intermediate heat exchanger 71*b*, a first flow switching device 72*a*, a second flow switching device 72*b*, a first pump 73*a*, a second pump 73*b*, a plurality of first flow switching devices 74*a* to 74*d*, a plurality of second flow switching devices 75*a* to 75*d*, and a plurality of load flow regulating devices 76*a* to 76*d*. The first flow control device 70*a* and the second flow control device 70*b* are each implemented by, for example, a device with a variable opening degree, such as an electronic expansion valve. The first flow control device 70*a* and the second flow control device 70*b* each function as a pressure reducing valve or expansion valve that allows refrigerant to expand by reducing its pressure.

The first flow control device 70*a* and the second flow control device 70*b* are located upstream of the first intermediate heat exchanger 71*a* and the second intermediate heat exchanger 71*b* in the primary-side cycle with respect to the flow of refrigerant in cooling only operation mode. The first intermediate heat exchanger 71*a* and the second intermediate heat exchanger 71*b* are each implemented by, for example, a double-pipe heat exchanger or a plate heat exchanger, and used to exchange heat between the refrigerant in the primary-side cycle and the refrigerant in the secondary-side cycle. The first intermediate heat exchanger 71*a* and the second intermediate heat exchanger 71*b* both act as evaporators when all of the indoor units being driven perform cooling, and both act condensers when all of the indoor units perform heating. When cooling and heating are mixed, one of the intermediate heat exchangers serves as a condenser, and the other intermediate heat exchanger serves as an evaporator.

The first flow switching device 72*a* and the second flow switching device 72*b* are each implemented by, for example, a four-way valve. The first flow switching device 72*a* and the second flow switching device 72*b* switch refrigerant flows in cooling only operation mode, cooling main operation mode, heating only operation mode, and heating main operation mode. The cooling only operation mode refers to the case where the first intermediate heat exchanger 71*a* and the second intermediate heat exchanger 71*b* both act as evaporators, the cooling main operation mode and the heating main operation mode refer to when the first intermediate heat exchanger 71*a* serves as an evaporator and the second intermediate heat exchanger 71*b* serves as a condenser, and the heating only operation mode refers to the case where the first intermediate heat exchanger 71*a* and the second intermediate heat exchanger 71*b* both act as condensers. The first flow switching device 72*a* and the second flow switching device 72*b* are located downstream of the first intermediate heat exchanger 71*a* and the second intermediate heat exchanger 71*b* in the primary-side cycle with respect to the flow of refrigerant in cooling only operation mode.

The first pump 73*a* and the second pump 73*b* are each implemented by, for example, an inverter-controlled centrifugal pump. The first pump 73*a* and the second pump 73*b* suck brine and raise its pressure. The first pump 73*a* and the second pump 73*b* are located upstream of the first intermediate heat exchanger 71*a* and the second intermediate heat exchanger 71*b* in the secondary-side cycle.

The number (four in this case) of first flow switching devices 74*a* to 74*d* equal to the number of indoor units 2*a* to 2*d* to be installed are provided, individually for the corresponding indoor units 2*a* to 2*d*. Each of the first flow switching devices 74*a* to 74*d* is implemented by, for example, a two-way valve, and switches whether the inflow side of the corresponding one of the indoor units 2*a* to 2*d* is to be connected to the flow path running from the first intermediate heat exchanger 71*a* or the flow path running from the second intermediate heat exchanger 71*b*. The first flow switching devices 74*a* to 74*d* are located downstream of the first intermediate heat exchanger 71*a* and the second intermediate heat exchanger 71*b* in the secondary-side cycle.

The number (four in this case) of second flow switching devices 75*a* to 75*d* equal to the number of indoor units 2*a* to 2*d* to be installed are provided, individually for the corresponding indoor units 2*a* to 2*d*. Each of the second flow switching devices 75*a* to 75*d* is implemented by, for example, a two-way valve, and switches whether the outflow side of the corresponding one of the indoor units 2*a* to 2*d* is to be connected to the flow path leading to the first pump 73*a* or the flow path leading to the second pump 73*b*. The second flow switching devices 75*a* to 75*d* are located upstream of the first pump 73*a* and the second pump 73*b* in the secondary-side cycle.

The load flow regulating devices 76*a* to 76*d* are each implemented by, for example, a device with a variable opening degree, such as an electronic expansion valve. The load flow regulating devices 76*a* to 76*d* each function as a pressure reducing valve that regulates the flow rate of brine entering the corresponding indoor unit. The load flow regulating devices 76*a* to 76*d* are located upstream of the second flow switching devices 75*a* to 75*d* in the secondary-side cycle with respect to the flow of refrigerant in cooling only operation mode. In the relay device 503, an inlet temperature sensor 81 is provided at the low pressure-side inlet of the refrigerant-to-refrigerant heat exchanger 50, and an outlet temperature sensor 82 is provided at the low pressure-side outlet of the refrigerant-to-refrigerant heat exchanger 50. Each of these temperature sensors may be implemented by a thermistor or other devices.

Further, in the relay device 503, inlet temperature sensors 83*a* and 83*b* are provided at the inlet for the primary-side cycle of the first intermediate heat exchanger 71*a* and the second intermediate heat exchanger 71*b*, and outlet temperature sensors 84*a* and 84*b* are provided at the outlet for the primary-side cycle of the first intermediate heat exchanger 71*a* and the second intermediate heat exchanger 71*b*. Each of these inlet and outlet temperature sensors may be implemented by a thermistor or other devices.

In the relay device 503, indoor unit inlet temperature sensors 85*a* and 85*b* are provided at the outlet for the secondary-side cycle of the first intermediate heat exchanger 71*a* and the second intermediate heat exchanger 71*b*, and indoor unit outlet temperature sensors 86*a* to 86*d* are provided at the inlet of the load flow regulating devices 76*a* to 76*d*. Each of these indoor unit inlet and outlet temperature sensors may be implemented by a thermistor or other devices. In the relay device 503, an outlet pressure sensor 87 is provided at the outlet side of the second intermediate heat exchanger 71*b*. The outlet pressure sensor 87 detects the pressure of high-pressure refrigerant.

[Cooling Only Operation Mode]

In cooling only operation mode, for the primary-side cycle, a high-pressure liquid refrigerant entering the relay device 503 passes through the third expansion device 15 before being sufficiently subcooled in the refrigerant-to-refrigerant heat exchanger 50. Most of the subcooled high-pressure refrigerant is then expanded in the first flow control device 70*a* and the second flow control device 70*b*, causing the refrigerant to change to a low-temperature, low-pressure refrigerant that is in a gas-liquid two-phase state. The remaining part of the high-pressure refrigerant is expanded in the fourth expansion device 27, causing the refrigerant to change to a low-temperature, low-pressure refrigerant that is in a gas-liquid two-phase state. Then, the low-pressure, low-temperature refrigerant in a gas-liquid two-phase state exchanges heat with a high-pressure liquid refrigerant in the refrigerant-to-refrigerant heat exchanger 50, resulting in a low-temperature, low-pressure gas refrigerant. This refrigerant then enters the low-pressure pipe at the outlet side of the relay device 503. During this process, the opening degree of the fourth expansion device 27 is controlled so as to maintain a constant level of superheat (degree of superheat), which is calculated as the difference between the temperature detected by the inlet temperature sensor 81 and the temperature detected by the outlet temperature sensor 82.

Most of the streams of low-temperature, low-pressure refrigerant in a gas-liquid two-phase state exiting the first flow control device 70*a* and the second flow control device 70*b* respectively enter the first intermediate heat exchanger 71*a* and the second intermediate heat exchanger 71*b* each serving as an evaporator where the refrigerant changes to a low-temperature, low-pressure gas refrigerant while cooling the brine. During this process, the opening degree of each of the first flow control device 70*a* and the second flow control device 70*b* is controlled so as to maintain a constant level of superheat (degree of superheat), which is calculated as the difference between the temperature detected by the inlet temperature sensor 83*a* or 83*b* and the temperature detected by the outlet temperature sensor 84*a* or 84*b*.

The gas refrigerant exiting each of the first intermediate heat exchanger 71*a* and the second intermediate heat exchanger 71*b* passes through the first flow switching device 72*a* and the second flow switching device 72*b*, and merges with the gas refrigerant exiting the refrigerant-to-refrigerant heat exchanger 50. The merged refrigerant exits the relay device 503, and passes through the main pipe 5 to enter the outdoor unit 501 again. The refrigerant entering the outdoor unit 501 is routed through the first backflow prevention device 13*d*, and passes through the refrigerant flow switching device 11 and the accumulator 19 before being sucked into the compressor 10 again.

As for the secondary-side cycle, the brine whose pressure has been elevated by the first pump 73*a* and the second pump 73*b* enters the first intermediate heat exchanger 71*a* and the second intermediate heat exchanger 71*b*. After having its temperature lowered in the first intermediate heat exchanger 71*a* and the second intermediate heat exchanger 71*b*, the brine passes through the first flow switching devices 74*a* to 74*d* that are being set to communicate with one or both of the first intermediate heat exchanger 71*a* and the second intermediate heat exchanger 71*b*, and then enters the load-side heat exchangers 26*a* to 26*d*. This brine cools the indoor air in the load-side heat exchangers 26*a* to 26*d* to perform cooling. During this cooling, the brine is heated by the indoor air. The resulting brine passes through the load flow regulating devices 76*a* to 76*d* and the second flow switching devices 75*a* to 75*d*, and returns to the first pump 73*a* and the second pump 73*b* in the relay device 503. During this process, each of the load flow regulating devices 76*a* to 76*d*, the first pump 73*a*, and the second pump 73*b* has its opening degree and applied voltage controlled so as to maintain a constant difference between the temperature detected by each of the indoor unit inlet temperature sensors 85*a* and 85*b*, and the temperature detected by each of the indoor unit outlet temperature sensors 86*a* and 86*b*.

[Cooling Main Operation Mode, Cooling Main Mode]

Upon entering the relay device 503, refrigerant in a gas-liquid two-phase state is separated into a high-pressure gas refrigerant and a high-pressure liquid refrigerant. The high-pressure gas refrigerant passes through the second flow switching device 72*b* before entering the second intermediate heat exchanger 71*b* serving as a condenser, where the high-pressure gas refrigerant changes to a liquid refrigerant while heating the brine. During this process, the opening degree of the second flow control device 70*b* is controlled so as to maintain a constant level of subcooling (degree of subcooling), which is calculated as the difference between a value obtained by converting the pressure detected by the outlet pressure sensor 87 into a saturation temperature, and the temperature detected by the inlet temperature sensor 83*b*. The liquid refrigerant exiting the second intermediate heat exchanger 71*b* is expanded in the second flow control device 70*b*.

Then, a medium-pressure liquid refrigerant that has been expanded to a medium pressure in the third expansion device 15 after undergoing separation at the inlet of the relay device 503, and the liquid refrigerant that has passed through the second flow control device 70*b* merge.

Most of the merged liquid refrigerant is expanded in the first flow control device 70*a*, causing the refrigerant to change to a low-temperature, low-pressure refrigerant that is in a gas-liquid two-phase state. The remaining part of the liquid refrigerant is expanded in the fourth expansion device 27, causing the refrigerant to change to a low-temperature, low-pressure refrigerant that is in a gas-liquid two-phase state. During this process, the opening degree of the fourth expansion device 27 is controlled so as to maintain a constant level of superheat (degree of superheat), which is calculated as the difference between the temperature detected by the inlet temperature sensor 81 and the temperature detected by the outlet temperature sensor 82. Then, the low-temperature, low-pressure refrigerant in a gas-liquid two-phase state exchanges heat with the high-pressure liquid refrigerant in the refrigerant-to-refrigerant heat exchanger 50, causing the refrigerant to change to a low-temperature, low-pressure gas refrigerant. This refrigerant then enters the low-pressure pipe at the outlet side of the relay device 503.

Most of the refrigerant in a gas-liquid two-phase state that has been expanded in the first flow control device 70*a* enters the first intermediate heat exchanger 71*a* serving as an evaporator, where the refrigerant changes to a low-temperature, low-pressure gas refrigerant while cooling the brine. During this process, the opening degree of the first flow control device 70*a* is controlled so as to maintain a constant level of superheat (degree of superheat), which is calculated as the difference between the temperature detected by the inlet-side temperature sensor 83*a* and the temperature detected by the outlet-side temperature sensor 84*a*. The gas refrigerant exiting the first intermediate heat exchanger 71*a* passes through the first flow switching device 72*a* before merging with the remaining part of the gas refrigerant that has exited the refrigerant-to-refrigerant heat exchanger 50. The merged refrigerant then exits the relay device 503, and passes through the main pipe 5 to enter the outdoor unit 201 again. The refrigerant entering the outdoor unit 501 is routed through the first backflow prevention device 13*d*, and passes through the refrigerant flow switching device 11 and the accumulator 19 before being sucked into the compressor 10 again.

The following description of the secondary-side cycle will be directed to a case where the indoor units 2*a* and 2*b* are performing a cooling operation, and the indoor unit 2*c* and 2*d* are performing a heating operation. For those indoor units where cooling is being performed, the brine whose pressure has been elevated by the first pump 73*a* enters the first intermediate heat exchanger 71*a*. After having its temperature lowered in the first intermediate heat exchanger 71*a*, the brine passes through the first flow switching devices 74*a* and 74*b* that are being set to communicate with the first intermediate heat exchanger 71*a*, and then enters the load-side heat exchangers 26*a* and 26*b*. This brine cools the indoor air in the load-side heat exchangers 26*a* and 26*b* to perform cooling. During this cooling, the brine is heated by the indoor air. The resulting brine passes through the load flow regulating devices 76*a* and 76*b* and the second flow switching devices 75*a* and 75*b*, and returns to the first pump 73*a* in the relay device 503. During this process, each of the load flow regulating devices 76*a* and 76*b*, and the first pump 73*a* has its opening degree and applied voltage controlled so as to maintain a constant difference between the temperature detected by the indoor unit inlet temperature sensor 85*a* and the temperature detected by each of the indoor unit outlet temperature sensors 86*a* and 86*b*.

For those indoor units where heating is being performed, the brine whose pressure has been elevated by the second pump 73*b* enters the second intermediate heat exchanger 71*b*. After having its temperature raised in the second intermediate heat exchanger 71*b*, the brine passes through the first flow switching devices 74*c* and 74*d* that are being set to communicate with the second intermediate heat exchanger 71*b*, and then enters the load-side heat exchangers 26*c* and 26*d*. This brine heats the indoor air in the load-side heat exchangers 26*c* and 26*d* to perform heating. During this heating, the brine is cooled by the indoor air. The resulting brine passes through the load flow regulating devices 76*c* and 76*d* and the second flow switching devices 75*c* and 75*d*, and returns to the second pump 73*b* in the relay device 503. During this process, the load flow regulating device 76*d* and the second pump 73*b* has its opening degree and applied voltage controlled so as to maintain a constant difference between the temperature detected by the indoor unit inlet temperature sensor 85*b* and the temperature detected by each of the indoor unit outlet temperature sensors 86*c* and 86*d*.

[Heating Only Operation Mode]

In this case, a high-temperature, high-pressure gas refrigerant entering the relay device 503 passes through the first flow switching device 72*a* and the second flow switching device 72*b* before entering each of the first intermediate heat exchanger 71*a* and the second intermediate heat exchanger 71*b* serving as a condenser. The refrigerant entering each of the first intermediate heat exchanger 71*a* and the second intermediate heat exchanger 71*b* changes into a liquid refrigerant while heating the brine. The exit streams of liquid refrigerant from the first intermediate heat exchanger 71*a* and the second intermediate heat exchanger 71*b* are respectively expanded in the first flow control device 70*a* and the second flow control device 70*b*, and pass through the fourth expansion device 27 that is being controlled to open, and the main pipe 5, before entering the outdoor unit 201 again. During this process, the opening degree of the load-side expansion device 25*a* is controlled so as to maintain a constant level of subcooling (degree of subcooling), which is calculated as the difference between a value obtained by converting the pressure detected by the outlet pressure sensor 87 into a saturation temperature, and the temperature detected by each of the inlet temperature sensors 83*a* and 83*b*.

As for the secondary-side cycle, the brine whose pressure has been elevated by the first pump 73*a* and the second pump 73*b* enters the first intermediate heat exchanger 71*a* and the second intermediate heat exchanger 71*b*. After having its temperature raised in the first intermediate heat exchanger 71*a* and the second intermediate heat exchanger 71*b*, the brine passes through the first flow switching devices 74*a* to 74*d* that are being set to communicate with one or both of the first intermediate heat exchanger 71*a* and the second intermediate heat exchanger 71*b*, and then enters the load-side heat exchangers 26*a* to 26*d*. This brine heats the indoor air in the load-side heat exchangers 26*a* to 26*d* to perform heating. During this heating, the brine is cooled by the indoor air. The resulting brine passes through the load flow regulating devices 76*a* to 76*d* and the second flow switching devices 75*a* to 75*d*, and returns to the first pump 73*a* and the second pump 73*b* in the relay device 503. During this process, each of the load flow regulating devices 76*a* to 76*d*, the first pump 73*a*, and the second pump 73*b* has its opening degree and applied voltage controlled so as to maintain a constant difference between the temperature detected by each of the indoor unit inlet temperature sensors 85*a* and 85*b*, and the temperature detected by each of the indoor unit outlet temperature sensors 86*a* and 86*b*.

Embodiments of the present invention are not limited to Embodiments 1 to 5 mentioned above but various modifications can be made. For example, although the foregoing description is directed to a case where the discharge temperature threshold is 115 degrees C. in cooling operation mode and heating operation mode, the discharge temperature threshold may be any value determined in accordance with the limit value of the discharge temperature of the compressor 10. For example, if the limit value of the discharge temperature of the compressor 10 is 120 degrees C., the operation of the compressor 10 is controlled by the controller 60 such that the discharge temperature does not exceed this value. For instance, when the discharge temperature exceeds 110 degrees C., the controller 60 lowers the frequency of the compressor 10 to lower the rotation speed of the compressor 10. Accordingly, if the discharge temperature of the compressor 10 is to be lowered by performing the above-mentioned injection, the discharge temperature threshold is preferably set to a temperature between 100 degrees C. and 110 degrees C. (for example, 105 degrees C.), slightly lower than the temperature threshold of 110 degrees C. at which the frequency of the compressor 10 is to be lowered. If, for example, the frequency of the compressor 10 is not lowered at the discharge temperature of 110 degrees C., the discharge temperature threshold at which the injection is to be performed to lower the discharge temperature may be set to a value between 100 degrees C. and 120 degrees C. (for example, 115 degrees C.).

Further, like, for example, an R32 refrigerant, other than an R32 refrigerant, a refrigerant mixture (zeotropic refrigerant mixture) of an R32 refrigerant and a refrigerant such as HFO1234yf or HFO1234ze, which is a tetrafluoropropene-based refrigerant having a low global warming potential and represented by the chemical formula CF3CF=Ch2, may be used as the refrigerant. When R32 is used as the refrigerant, in particular, the discharge temperature under the same operating condition is higher by approximately 20 degrees C. than that when R410A is used. This necessitates lowering of the discharge temperature, and thus the effect of the injection according to the present invention is significant in this respect. The effect of the injection is particularly significant when a refrigerant with a comparatively high discharge temperature is used.

For a refrigerant mixture of an R32 refrigerant and HFO1234yf, when the mass fraction of R32 is equal to or higher than 62% (62 wt %), the discharge temperature is higher by three degrees C. or more than that when an R410A refrigerant is used. Thus, the effect of lowering discharge temperature through the injection according to the present invention is significant. For a refrigerant mixture of R32 and HFO1234ze, when the mass fraction of R32 is equal to or higher than 43% (43 wt %), the discharge temperature is higher by three degrees C. or more than that when an R410A refrigerant is used. Thus, the effect of lowering discharge temperature through injection in the air-conditioning apparatuses 100 to 500 mentioned above is significant. The kinds of refrigerant present in a refrigerant mixture are not limited to the above. Use of a refrigerant mixture containing a small amount of one or more other refrigerant components does not significantly affect discharge temperature and thus provides the same effect. The configuration employed may be used also for, for example, a refrigerant mixture containing R32, HFO1234yf, and a small amount of one or more other refrigerants. For any refrigerant whose discharge temperature becomes higher than that of R410A, there is a need to lower the discharge temperature, and thus the same effect can be obtained.

Further, for situations where a refrigerant whose high-pressure side operates under supercritical conditions, such as CO2 (R744), is used as the refrigerant in each of Embodiments 1 to 5 mentioned above, and the discharge temperature of the refrigerant needs to be lowered, employing the refrigerant circuit configuration according to Embodiments makes it possible to lower the discharge temperature.

Although Embodiments 1 to 5 mentioned above are directed to a case where the auxiliary heat exchanger 40 and the heat source-side heat exchanger 12 are integrally constructed, the auxiliary heat exchanger 40 may be disposed as an independent component. In another alternative configuration, the auxiliary heat exchanger 40 may be disposed on the upper side. Although the foregoing description is directed to a case where the auxiliary heat exchanger 40 is located on the lower side of the fins, and the heat source-side heat exchanger 12 is located on the upper side of the heat transfer fins, alternatively, the auxiliary heat exchanger 40 may be located on the upper side, and the heat source-side heat exchanger 12 may be located on the lower side.

Although the air-conditioning apparatus capable of concurrent cooling and heating operation according to each of Embodiments 2 and 3 above employs a pipe connection in which two main pipes 5 are used to connect the outdoor unit 201 and the relay device 3, the pipe connection is not limited to this but various known methods may be used. For example, an excessive rise in the temperature of high-pressure, high-temperature gas refrigerant discharged from the compressor 10 can be limited as in Embodiment 2 mentioned above also when the air-conditioning apparatus capable of concurrent cooling and heating operation is configured such that the outdoor unit 1 and the relay device 3 are connected by using three main pipes 5.

Although the foregoing description is directed to a case where a low-pressure shell compressor is used as the compressor 10 according to Embodiments 1 to 5, the same effect can be obtained when, for example, a high-pressure shell compressor is used.

Although the foregoing description is directed to a case where a compressor that does not have a structure for routing refrigerant into its medium-pressure part is used as the compressor 10, the present invention is also applicable to compressors including an injection port for routing refrigerant into the medium-pressure part of the compressor 10.

Although it is common to attach a blower device to the heat source-side heat exchanger 12 and the load-side heat exchangers 26*a* to 26*d* to blow air through the heat exchangers to promote condensation or evaporation, this is not to be construed in a limiting sense. For example, devices such as panel heaters that utilize radiation may be also used as the load-side heat exchangers 26*a* to 26*d*. The heat source-side heat exchanger 12 used may be a water-cooled heat exchanger that uses a fluid such as water or antifreeze to exchange heat. Any heat exchanger that allows refrigerant to reject heat or remove heat may be used. If a water-cooled heat exchanger is to be used, for example, a plate heat exchanger may be used as the auxiliary heat exchanger 40.

Further, although the foregoing description is directed to a direct-expansion air-conditioning apparatus in which the outdoor unit 1 and the indoor unit 2, or the outdoor unit 1, the relay device 3, and the indoor unit 2 are connected by pipes to circulate refrigerant, as well as an indirect air-conditioning apparatus in which the relay device 3 is connected between the outdoor unit 1 and the indoor unit 2, heat exchangers that allow heat exchange between refrigerant and a heat medium such as water or brine, such as plate heat exchangers, are provided inside the relay device 3 as the load-side heat exchangers 26*a* and 26*b*, and heat exchangers 28*a* to 28*d* are respectively provided in the indoor units 2*a* to 2*d*, this is not to be construed in a limiting sense. The present invention is also applicable to an air-conditioning apparatus in which refrigerant is circulated only within the outdoor unit, and a heat medium such as water or brine is circulated between the outdoor unit, the relay device, and the indoor unit, with the refrigerant and the heat medium allowed to exchange heat in the outdoor unit for air conditioning.

REFERENCE SIGNS LIST

1, 201, 301, 401, 501 outdoor unit 2, 2*a* to 2*d* indoor unit 3, 503 relay device 4 refrigerant pipe 4*a* first connecting pipe

4*b* second connecting pipe 5 main pipe 6 branch pipe 10 compressor 11 refrigerant flow switching device 12 heat source-side heat exchanger 13*a* to 13*d* first backflow prevention device 13*g* backflow prevention device 14 gas-liquid separator 15 third expansion device 16 fan 19 accumulator 21*a* to 21*d* second backflow prevention device 22*a* to 22*d* third backflow prevention device 23*a* to 23*d* first opening and closing device 24*a* to 24*d* second opening and closing device 25, 25*a* to 25*d* load-side expansion device 26, 26*a* to 26*d* load-side heat exchanger 27 fourth expansion device 28*a* heat exchanger 31, 31*a* to 31*d* inlet-side temperature sensor 32, 32*a* to 32*d* outlet-side temperature sensor 33 inlet-side pressure sensor 34 outlet-side pressure sensor 40 auxiliary heat exchanger 41 bypass pipe 42 flow regulating unit 43 discharge temperature sensor 44 refrigerating machine oil temperature sensor 45 low-side pressure sensor 46 outside air temperature sensor 47 opening and closing device 48 first branching pipe 49 second branching pipe 50 refrigerant-to-refrigerant heat exchanger 51 temperature sensor 60 controller 70*a* first flow control device 70*b* second flow control device 71*a* first intermediate heat exchanger 71*b* second intermediate heat exchanger 72*a* first flow switching device 72*b* second flow switching device 73*a* first pump 73*b* second pump 74*a* to 74*d* first flow switching device 75*a* to 75*d* second flow switching device 76*a* to 76*d* load flow regulating device 81 inlet temperature sensor 82 outlet temperature sensor 83*a*, 83*b* inlet temperature sensor 84*a*, 84*b* outlet temperature sensor 85*a*, 85*b* indoor unit inlet temperature sensor 86*a* to 86*d* indoor unit outlet temperature sensor outlet-side pressure sensor, 100, 200, 300, 400, 500 air-conditioning apparatus A1 total heat transfer area A2 total heat transfer area B intervening area Gr total refrigerant flow rate $Gr_2$ refrigerant flow rate Q1 amount of heat exchange T1, T2 temperature h, $h_1$, $h_2$, $h_3$ enthalpy k overall heat transmission coefficient ΔTm logarithmic mean temperature difference

The invention claimed is:

1. An air-conditioning apparatus comprising:

a refrigeration cycle in which refrigerant circulates, the refrigeration cycle including a compressor, a refrigerant flow switching device, a heat source-side heat exchanger, a load-side expansion device, and a load-side heat exchanger that are connected by a refrigerant pipe, the refrigeration cycle being configured to perform cooling operation and heating operation, by switching flow of the refrigerant by the refrigerant flow switching device;

a bypass pipe having one end connected to a pipe through which refrigerant having a high-side pressure flows, and being configured to:

in the cooling operation, allow a part of the refrigerant routed from the heat-source side heat exchanger, being in a liquid state and having a high-side pressure, to flow therethrough, and in the heating operation, allow a part of refrigerant discharged from the compressor, being in a gas state and having the high-side pressure, to flow therethrough;

an auxiliary heat exchanger connected to an other end of the bypass pipe and a suction part of the compressor, and configured to cool, by air, refrigerant flowing through the bypass pipe and supply the cooled refrigerant to the suction part of the compressor; and a flow regulating unit provided on a refrigerant outlet side of the auxiliary heat exchanger, and configured to regulate a flow rate of refrigerant routed into the suction part of the compressor from the auxiliary heat exchanger.

2. The air-conditioning apparatus of claim 1, further comprising:

a discharge temperature sensor configured to detect a discharge temperature of refrigerant discharged from the compressor; and a controller configured to control an opening degree of the flow regulating unit based on the discharge temperature detected by the discharge temperature sensor, the controller being configured to regulate, when the discharge temperature detected by the discharge temperature sensor is higher than a discharge temperature threshold, the opening degree of the flow regulating unit to make the discharge temperature equal to or lower than the discharge temperature threshold.

3. The air-conditioning apparatus of claim 2, wherein a settable upper limit of the discharge temperature threshold is 115 degrees C.

4. The air-conditioning apparatus of claim 1, wherein the heat source-side heat exchanger and the auxiliary heat exchanger form different refrigerant flow paths by respectively including heat transfer tubes that are coupled to a same heat transfer fin, and are configured to allow air around the heat source-side heat exchanger to flow through both the heat source-side heat exchanger and the auxiliary heat exchanger, and the auxiliary heat exchanger has a heat transfer area smaller than a heat transfer area of the heat source-side heat exchanger.

5. The air-conditioning apparatus of claim 4, wherein the auxiliary heat exchanger has a heat transfer area necessary for cooling and liquefying incoming refrigerant to route the refrigerant in a liquid state into the flow regulating unit.

6. The air-conditioning apparatus of claim 4, wherein A1/(A1+A2) is not lower than 1.62% and not higher than 5%, where A1 is an area of contact of the auxiliary heat exchanger with air, and A2 is an area of contact of the heat source-side heat exchanger with air.

7. The air-conditioning apparatus of claim 1, wherein the bypass pipe has the one end branched to a first branching pipe and a second branching pipe, wherein the first branching pipe is connected to a refrigerant pipe extending between the load-side expansion device and the heat source-side heat exchanger, wherein the second branching pipe is connected to a refrigerant pipe extending between a flow path at the discharge side of the compressor and the refrigerant flow switching device, wherein one end of the first branching pipe and one end of the second branching pipe merge and are connected to the bypass pipe, and the second branching pipe is provided with an opening and closing device that regulates a flow rate of refrigerant entering the bypass pipe.

8. The air-conditioning apparatus of claim 7, wherein the first branching pipe is provided with a backflow prevention device to prevent backflow.

9. The air-conditioning apparatus of claim 7, further comprising a controller configured to control the opening and closing device to close in the cooling operation and control the opening and closing device to open in the heating operation, wherein the second branching pipe is configured to allow a part of refrigerant discharged from the compressor to enter the auxiliary heat exchanger via the bypass pipe in the heating operation.

10. The air-conditioning apparatus of claim 1, wherein the compressor, the refrigerant flow switching device, and the heat source-side heat exchanger are installed in an outdoor unit, the load-side expansion device and the load-side heat exchanger are installed in an indoor unit, and the outdoor unit and the indoor unit are connected so as to circulate refrigerant via a relay device.

11. The air-conditioning apparatus of claim 10, further comprising a first backflow prevention device connected between a flow path at an outlet side of the heat source-side heat exchanger, and a flow path at an inlet side of the relay device;

a second backflow prevention device connected between a flow path at an outlet side of the relay device, and the refrigerant flow switching device;

a third backflow prevention device that connects a pipe extending between the second backflow prevention device and the refrigerant flow switching device, with a pipe extending between the first backflow prevention device and an inlet of the relay device; and a fourth backflow prevention device that connects a pipe extending between an outlet of the relay device and the second backflow prevention device, with a pipe extending between the first backflow prevention device and the heat source-side heat exchanger, wherein the one end of the bypass pipe is connected between the first backflow prevention device and the inlet of the relay device.

12. The air-conditioning apparatus of claim 7, wherein A1/(A1+A2) is not lower than 0.14% and not higher than 5%, where A1 is an area of contact of the auxiliary heat exchanger with air, and A2 is an area of contact of the heat source-side heat exchanger with air.

13. The air-conditioning apparatus of claim 1, wherein the compressor comprises a compressor with a low-pressure shell structure.

14. The air-conditioning apparatus of claim 13, further comprising:

a refrigerating machine oil temperature sensor configured to detect a refrigerant machine oil temperature of the compressor;

a low-side pressure sensor provided at a suction side of the compressor to detect a low-side pressure of refrigerant; and a controller configured to control an opening degree of the flow regulating unit based on a degree of refrigerating machine oil superheat, the degree of refrigerating machine oil superheat representing a difference between the refrigerant machine oil temperature detected by the refrigerating machine oil temperature sensor and an evaporating temperature calculated by using the low-side pressure detected by the low-side pressure sensor, wherein the controller is configured to control, when the degree of refrigerating machine oil superheat is lower than a threshold degree of refrigerating machine oil superheat, the opening degree of the flow regulating unit to make the degree of refrigerating machine oil superheat equal to or higher than the threshold degree of refrigerating machine oil superheat.

15. The air-conditioning apparatus of claim 14, wherein a settable lower limit of the threshold degree of refrigerating machine oil superheat is 10 degrees C.

* * * * *